US009730524B2

(12) United States Patent
Chen et al.

(10) Patent No.: US 9,730,524 B2
(45) Date of Patent: Aug. 15, 2017

(54) SWITCHING MEANS FOR AN ADJUSTABLE FOUNDATION SYSTEM

(71) Applicant: Select Comfort Corporation, Minneapolis, MN (US)

(72) Inventors: Yi-ching Chen, Maple Grove, MN (US); John McGuire, New Hope, MN (US); Stacy Stusynski, Blaine, MN (US)

(73) Assignee: Select Comfort Corporation, Minneapolis, MN (US)

( * ) Notice: Subject to any disclaimer, the term of this patent is extended or adjusted under 35 U.S.C. 154(b) by 612 days.

(21) Appl. No.: 14/203,050

(22) Filed: Mar. 10, 2014

(65) Prior Publication Data

US 2014/0257571 A1 Sep. 11, 2014

Related U.S. Application Data

(60) Provisional application No. 61/776,447, filed on Mar. 11, 2013.

(51) Int. Cl.

| | |
|---|---|
| ***A47C 20/04*** | (2006.01) |
| ***A47C 27/08*** | (2006.01) |
| ***A47C 31/00*** | (2006.01) |

(52) U.S. Cl.

CPC ..... *A47C 27/082* (2013.01); *A47C 20/041* (2013.01); *A47C 27/083* (2013.01); *A47C 31/008* (2013.01)

(58) Field of Classification Search

CPC ..... A47C 20/04
USPC ..... 5/613–618
See application file for complete search history.

(56) References Cited

U.S. PATENT DOCUMENTS

| | | | |
|---|---|---|---|
| 771,076 | A | 9/1904 | Kintz |
| 2,702,909 | A | 3/1955 | Thomas |
| 2,850,252 | A | 9/1958 | Ford |
| 3,072,776 | A | 1/1963 | Quenneville |
| 3,089,150 | A | 5/1963 | Briggs et al. |
| 3,644,946 | A | 2/1972 | Swatt |

(Continued)

FOREIGN PATENT DOCUMENTS

| | | |
|---|---|---|
| EP | 1321121 | 6/2003 |
| WO | WO 2008/128250 | 10/2008 |
| WO | WO 2012/005963 | 1/2012 |

OTHER PUBLICATIONS

International Preliminary Report on Patentability and Written Opinion in International Application No. PCT/US2014/022705, dated Sep. 24, 2015, 7 pages.

(Continued)

*Primary Examiner* — Frederick Conley
(74) *Attorney, Agent, or Firm* — Fish & Richardson P.C.

(57) ABSTRACT

In one example, this disclosure describes an adjustable bed system that includes first and second adjustable foundations, at least one first motor to adjust the first adjustable foundation, at least one second motor to adjust the second adjustable foundation, a configurable device having a first state and a second state, and a central controller in communication with the device, the controller configured to receive an input representing one of the first state and the second state, the controller including a processor configured to control the at least one first motor and the at least one second motor based on the received input.

13 Claims, 15 Drawing Sheets

(56) References Cited

U.S. PATENT DOCUMENTS

| | | | | |
|---|---|---|---|---|
| 3,646,621 | A | 3/1972 | Fragas | |
| 3,795,019 | A | 3/1974 | Fragas | |
| 3,978,530 | A | 9/1976 | Amarantos | |
| 4,766,628 | A | 8/1988 | Walker | |
| 4,788,729 | A | 12/1988 | Walker | |
| 4,829,616 | A | 5/1989 | Walker | |
| 4,890,344 | A | 1/1990 | Walker | |
| 4,893,365 | A | 1/1990 | Justice | |
| 4,897,890 | A | 2/1990 | Walker | |
| 4,908,895 | A | 3/1990 | Walker | |
| 4,991,244 | A | 2/1991 | Walker | |
| 5,144,706 | A | 9/1992 | Walker et al. | |
| 5,170,522 | A | 12/1992 | Walker | |
| 5,315,726 | A | 5/1994 | Borenstein | |
| 5,509,154 | A | 4/1996 | Shafer et al. | |
| 5,537,701 | A | 7/1996 | Elliott | |
| 5,564,140 | A | 10/1996 | Shoenhair et al. | |
| 5,642,546 | A | 7/1997 | Shoenhair | |
| 5,652,484 | A | 7/1997 | Shafer et al. | |
| 5,765,246 | A | 6/1998 | Shoenhair | |
| 5,903,941 | A | 5/1999 | Shafer et al. | |
| 5,904,172 | A | 5/1999 | Gifft et al. | |
| 6,008,598 | A * | 12/1999 | Luff ..... | A47C 31/008 318/16 |
| 6,037,723 | A | 3/2000 | Shafer et al. | |
| 6,108,844 | A | 8/2000 | Kraft et al. | |
| 6,161,231 | A | 12/2000 | Kraft et al. | |
| 6,202,239 | B1 | 3/2001 | Ward et al. | |
| 6,311,347 | B1 | 11/2001 | Limardi et al. | |
| 6,397,419 | B1 | 6/2002 | Mechache | |
| 6,483,264 | B1 | 11/2002 | Shafer et al. | |
| 6,686,711 | B2 | 2/2004 | Rose et al. | |
| 6,698,043 | B2 | 3/2004 | Fabian | |
| 6,708,357 | B2 | 3/2004 | Gaboury et al. | |
| 6,763,541 | B2 | 7/2004 | Mahoney et al. | |
| 6,804,848 | B1 | 10/2004 | Rose | |
| 6,832,397 | B2 | 12/2004 | Gaboury et al. | |
| 6,883,191 | B2 | 4/2005 | Gaboury et al. | |
| 6,951,037 | B2 | 10/2005 | Weinman | |
| 7,017,210 | B2 | 3/2006 | Ooyama et al. | |
| 7,389,554 | B1 | 6/2008 | Rose | |
| 2,689,961 | A1 | 8/2010 | Lieberthal | |
| 7,865,988 | B2 | 1/2011 | Koughan et al. | |
| 8,117,693 | B1 | 2/2012 | Helton | |
| 8,266,746 | B2 | 9/2012 | Oh et al. | |
| 8,282,452 | B2 | 10/2012 | Grigsby et al. | |
| 8,336,369 | B2 | 12/2012 | Mahoney | |
| 8,444,558 | B2 | 5/2013 | Young et al. | |
| D687,210 | S | 8/2013 | Krafnick et al. | |
| 8,672,853 | B2 | 3/2014 | Young | |
| 8,769,747 | B2 | 7/2014 | Mahoney et al. | |
| 8,909,357 | B2 | 12/2014 | Rawls-Meehan | |
| 8,931,329 | B2 | 1/2015 | Mahoney et al. | |
| 8,966,689 | B2 | 3/2015 | McGuire et al. | |
| 8,973,183 | B1 | 3/2015 | Palashewski et al. | |
| 8,984,687 | B2 | 3/2015 | Stusynski et al. | |
| 2003/0217411 | A1 | 11/2003 | Bradley et al. | |
| 2006/0031987 | A1 | 2/2006 | Stanfield et al. | |
| 2008/0077020 | A1 | 3/2008 | Young et al. | |
| 2008/0262657 | A1 * | 10/2008 | Howell ..... | A47C 20/041 700/275 |
| 2010/0174198 | A1 | 7/2010 | Young et al. | |
| 2011/0144455 | A1 | 6/2011 | Young et al. | |
| 2011/0306844 | A1 | 12/2011 | Young | |
| 2012/0138067 | A1 | 6/2012 | Rawls-Meehan | |
| 2013/0014326 | A1 | 1/2013 | Kane et al. | |
| 2014/0007656 | A1 | 1/2014 | Mahoney | |
| 2014/0137332 | A1 | 5/2014 | McGuire et al. | |
| 2014/0182061 | A1 | 7/2014 | Zaiss | |
| 2014/0250597 | A1 | 9/2014 | Chen et al. | |
| 2014/0259417 | A1 | 9/2014 | Nunn et al. | |
| 2014/0259418 | A1 | 9/2014 | Nunn et al. | |
| 2014/0259419 | A1 | 9/2014 | Stusynski | |
| 2014/0259431 | A1 | 9/2014 | Fleury | |
| 2014/0259433 | A1 | 9/2014 | Nunn et al. | |
| 2014/0259434 | A1 | 9/2014 | Nunn et al. | |
| 2014/0277611 | A1 | 9/2014 | Nunn et al. | |
| 2014/0277778 | A1 | 9/2014 | Nunn et al. | |
| 2014/0277822 | A1 | 9/2014 | Nunn et al. | |
| 2015/0007393 | A1 | 1/2015 | Palashewski | |
| 2015/0025327 | A1 | 1/2015 | Young et al. | |
| 2015/0026896 | A1 | 1/2015 | Fleury et al. | |
| 2015/0157137 | A1 | 6/2015 | Nunn et al. | |
| 2015/0157519 | A1 | 6/2015 | Stusynski et al. | |
| 2015/0182033 | A1 | 7/2015 | Brosnan et al. | |
| 2015/0182397 | A1 | 7/2015 | Palashewski et al. | |
| 2015/0182399 | A1 | 7/2015 | Rose et al. | |
| 2015/0182418 | A1 | 7/2015 | Zaiss | |
| 2015/0328070 | A1 | 11/2015 | Tarplee et al. | |

OTHER PUBLICATIONS

U.S. Appl. No. 14/283,675, filed May 21, 2014, Mahoney et al.
U.S. Appl. No. 14/675,355, filed Mar. 31, 2015, Palashewski et al.
U.S. Appl. No. 14/687,633, filed Apr. 15, 2015, Brosnan et al.
U.S. Appl. No. 13/933,285, filed Jul. 2, 2013, Palashewski.
U.S. Appl. No. 14/146,327, filed Jan. 2, 2014, Palashewski et al.
U.S. Appl. No. 14/146,281, filed Jan. 2, 2014, Palashewski et al.

* cited by examiner

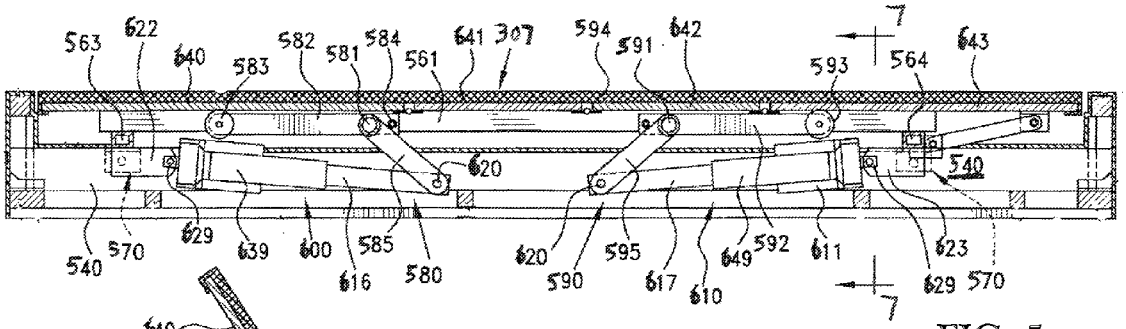
FIG. 5
FIG. 6
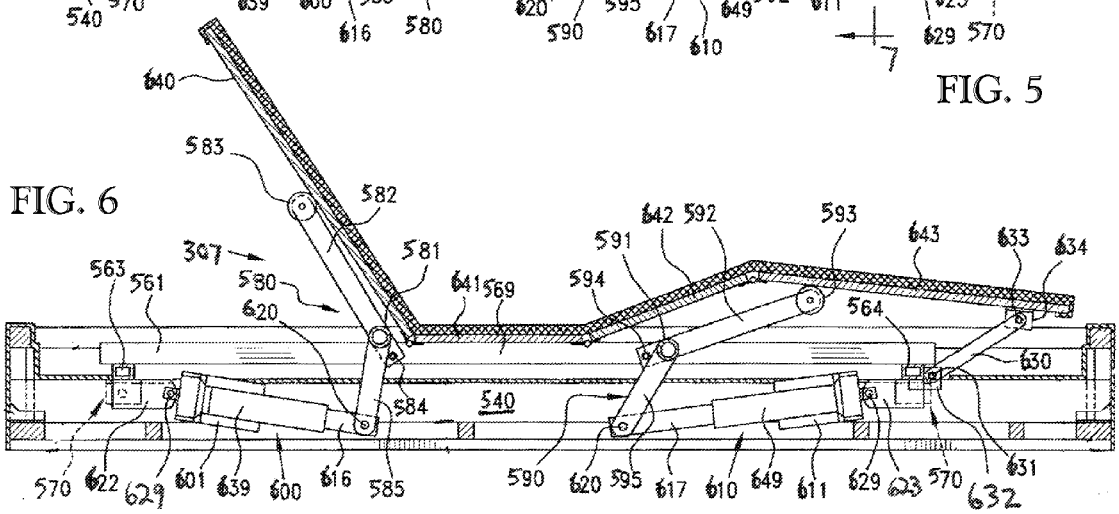

SWITCHING MEANS FOR AN ADJUSTABLE FOUNDATION SYSTEM

This application is related to U.S. Provisional Application No. 61/776,447 titled, "SWITCHING MEANS FOR AN ADJUSTABLE FOUNDATION SYSTEM" to Chen et al. and filed on Mar. 11, 2013, the entire content being incorporated herein by reference in its entirety, and the benefit of priority claimed herein.

TECHNICAL FIELD

This patent document pertains generally to mattresses and more particularly, but not by way of limitation, to an inflatable air mattress system.

BACKGROUND

Air bed systems, such as the one described in U.S. Pat. No. 5,904,172 which is incorporated herein by reference in its entirety, generally allow a user to select a desired pressure for each air chamber within the mattress. Upon selecting the desired pressure, a signal is sent to a pump and valve assembly in order to inflate or deflate the air bladders as necessary in order to achieve approximately the desired pressure within the air bladders.

In various examples, an air mattress control system allows a user to adjust the firmness or position of an air mattress bed. The mattress may have more than one zone thereby allowing a left and right side of the mattress to be adjusted to different firmness levels. Additionally, the bed may be adjustable to different positions. For example, the head section of the bed may be raised up while the foot section of the bed stays in place. In various examples, two separate remote controls are used to adjust the position and firmness, respectively.

BRIEF DESCRIPTION OF DRAWINGS

Some embodiments are illustrated by way of example and not limitation in the figures of the accompanying drawings in which:

FIG. 5 is an enlarged longitudinal cross-sectional view taken through the adjustable bed of FIG. 1, and illustrates the unitized adjustable bed mechanism including its support frame, headboard and footboard adjusting linkage mechanisms and drive mechanisms therefor housed within a cavity of the bed foundation.

FIG. 6 is a longitudinal sectional view similar to FIG. 5, and illustrates the various components moved to an adjusted position.

DETAILED DESCRIPTION

Figure 1:
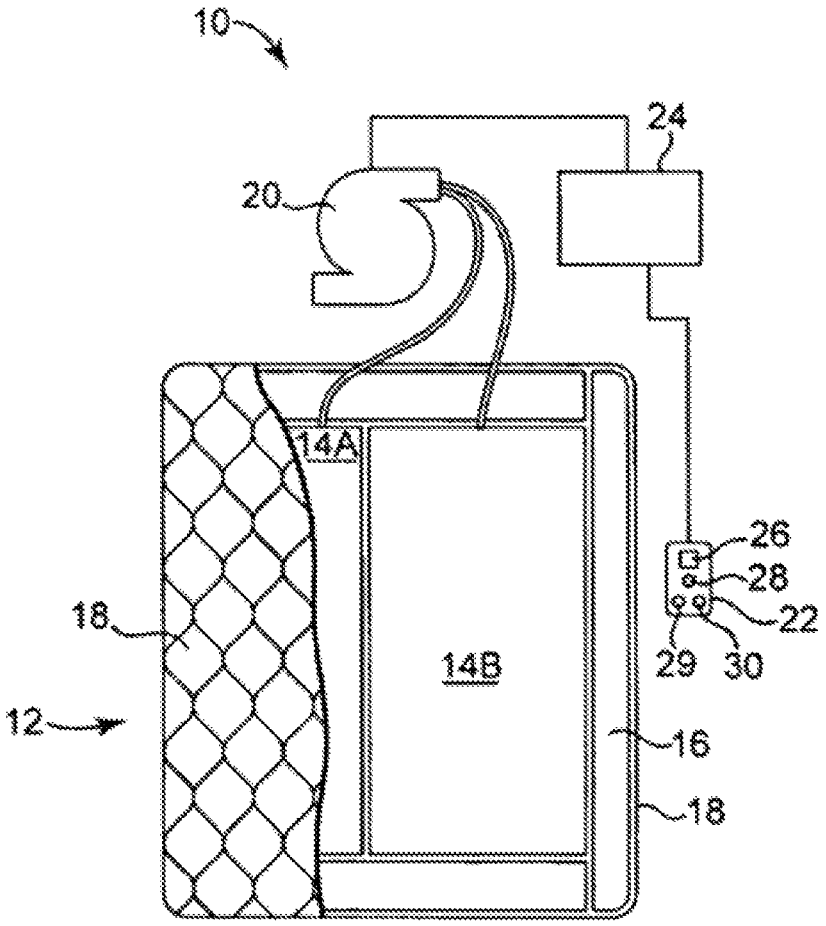
FIG. 1 is a diagrammatic representation of an air bed system, according to an example.

FIG. 1 is a diagrammatic representation of air bed system 10 in an example embodiment. System 10 can include bed 12, which can comprise at least one air chamber 14 surrounded by a resilient border 16 and encapsulated by bed ticking 18. The resilient border 16 can comprise any suitable material, such as foam.

As illustrated in FIG. 1, bed 12 can be a two chamber design having a first air chamber 14A and a second air chamber 14B. First and second air chambers 14A and 14B can be in fluid communication with pump 20. Pump 20 can be in electrical communication with a remote control 22 via control box 24. Remote control 22 can communicate via wired or wireless means with control box 24. Control box 24 can be configured to operate pump 20 to cause increases and decreases in the fluid pressure of first and second air chambers 14A and 14B based upon commands input by a user through remote control 22. Remote control 22 can include display 26, output selecting means 28, pressure increase button 29, and pressure decrease button 30. Output selecting means 28 can allow the user to switch the pump output between the first and second air chambers 14A and 14B, thus enabling control of multiple air chambers with a single remote control 22. For example, output selecting means may by a physical control (e.g., switch or button) or an input control displayed on display 26. Alternatively, separate remote control units can be provided for each air chamber and may each include the ability to control multiple air chambers. Pressure increase and decrease buttons 29 and 30 can allow a user to increase or decrease the pressure, respectively, in the air chamber selected with the output selecting means 28. Adjusting the pressure within the selected air chamber can cause a corresponding adjustment to the firmness of the air chamber.

Figure 2:
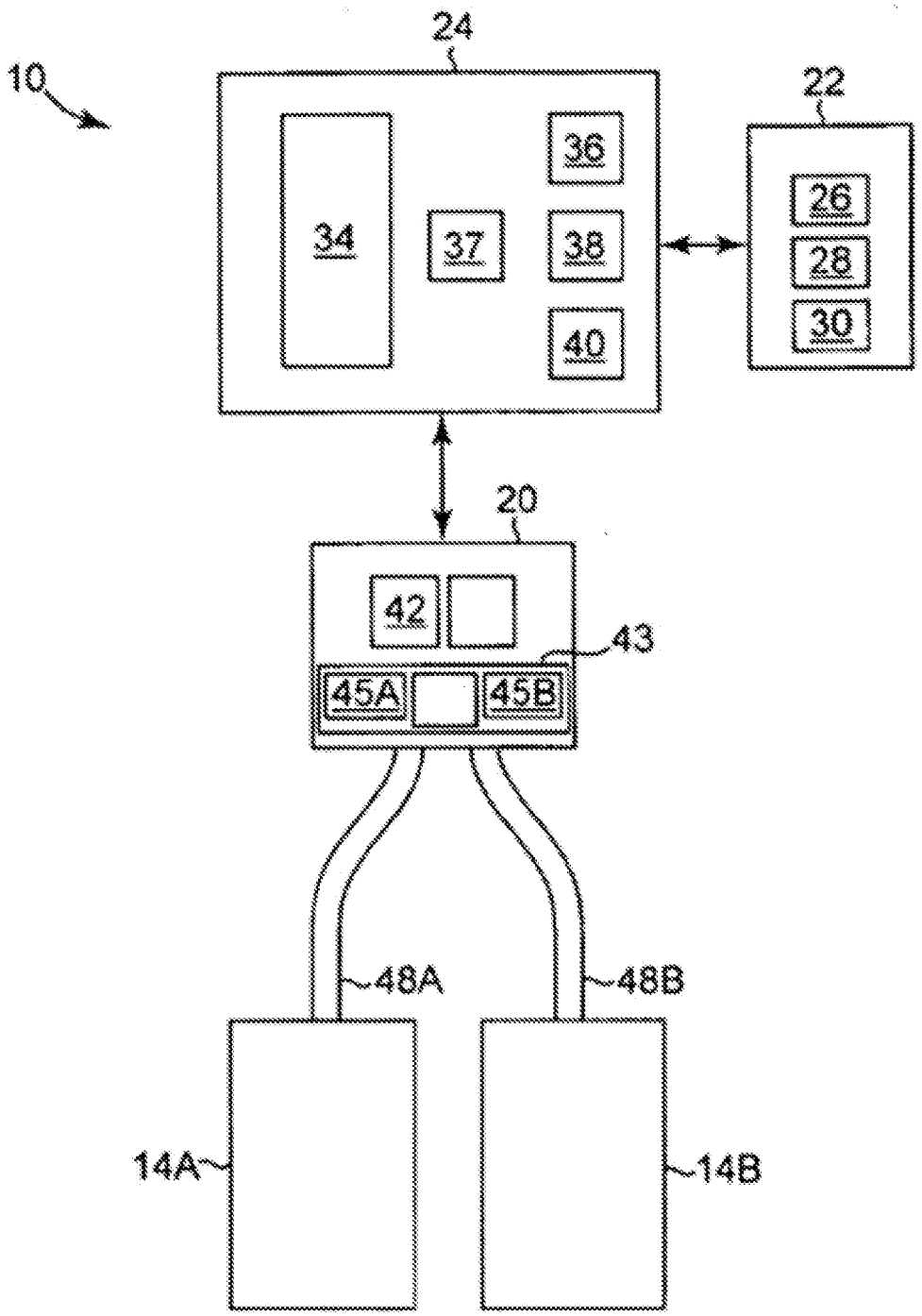
FIG. 2 is a block diagram of various components of the air bed system of FIG. 1, according to an example.

FIG. 2 is a block diagram detailing data communication between certain components of air bed system 10 according to various examples. As shown in FIG. 2, control box 24 can include power supply 34, processor 36, memory 37, switching means 38, and analog to digital (A/D) converter 40. Switching means 38 can be, for example, a relay or a solid state switch. Switching means 38 can be located in the pump 20 rather than the control box 24.

Pump 20 and remote control 22 can be in two-way communication with the control box 24. Pump 20 can include a motor 42, a pump manifold 43, a relief valve 44, a first control valve 45A, a second control valve 45B, and a pressure transducer 46, and can be fluidly connected with the first air chamber 14A and the second air chamber 14B via a first tube 48A and a second tube 48B, respectively. First and second control valves 45A and 45B can be controlled by switching means 38, and can be operable to regulate the flow of fluid between pump 20 and first and second air chambers 14A and 14B, respectively.

In an example, pump 20 and control box 24 can be provided and packaged as a single unit. Alternatively, pump 20 and control box 24 can be provided as physically separate units.

In operation, power supply 34 can receive power, such as 110 VAC power, from an external source and can convert the power to various forms required by certain components of the air bed system 10. Processor 36 can be used to control various logic sequences associated with operation of the air bed system 10, as will be discussed in further detail below.

The example of the air bed system 10 shown in FIG. 2 contemplates two air chambers 14A and 14B and a single pump 20. However, other examples may include an air bed system having two or more air chambers and one or more pumps incorporated into the air bed system to control the air chambers. In an example, a separate pump can be associated with each air chamber of the air bed system or a pump may be associated with multiple chambers of the air bed system. Separate pumps can allow each air chamber to be inflated or deflated independently and simultaneously. Furthermore, additional pressure transducers can also be incorporated into the air bed system such that, for example, a separate pressure transducer can be associated with each air chamber.

In the event that the processor 36 sends a decrease pressure command to one of air chambers 14A or 14B, switching means 38 can be used to convert the low voltage command signals sent by processor 36 to higher operating voltages sufficient to operate relief valve 44 of pump 20 and open control valves 45A or 45B. Opening relief valve 44 can allow air to escape from air chamber 14A or 14B through the respective air tube 48A or 48B. During deflation, pressure transducer 46 can send pressure readings to processor 36 via the A/D converter 40. The A/D converter 40 can receive analog information from pressure transducer 46 and can convert the analog information to digital information useable by processor 36. Processor 36 may send the digital signal to remote control 22 to update display 26 on the remote control in order to convey the pressure information to the user.

In the event that processor 36 sends an increase pressure command, pump motor 42 can be energized, sending air to the designated air chamber through air tube 48A or 48B via electronically operating corresponding valve 45A or 45B. While air is being delivered to the designated air chamber in order to increase the firmness of the chamber, pressure transducer 46 can sense pressure within pump manifold 43. Again, pressure transducer 46 can send pressure readings to processor 36 via A/D converter 40. Processor 36 can use the information received from A/D converter 40 to determine the difference between the actual pressure in air chamber 14A or 14B and the desired pressure. Processor 36 can send the digital signal to remote control 22 to update display 26 on the remote control in order to convey the pressure information to the user.

Generally speaking, during an inflation or deflation process, the pressure sensed within pump manifold 43 provides an approximation of the pressure within the air chamber. An example method of obtaining a pump manifold pressure reading that is substantially equivalent to the actual pressure within an air chamber is to turn off pump 20, allow the pressure within the air chamber 14A or 14B and pump manifold 43 to equalize, and then sense the pressure within pump manifold 43 with pressure transducer 46. Thus, providing a sufficient amount of time to allow the pressures within pump manifold 43 and chamber 14A or 14B to equalize may result in pressure readings that are accurate approximations of the actual pressure within air chamber 14A or 14B. In various examples, the pressure of 48A/B is continuously monitored using multiple pressure sensors.

In an example, another method of obtaining a pump manifold pressure reading that is substantially equivalent to the actual pressure within an air chamber is through the use of a pressure adjustment algorithm. In general, the method can function by approximating the air chamber pressure based upon a mathematical relationship between the air chamber pressure and the pressure measured within pump manifold 43 (during both an inflation cycle and a deflation cycle), thereby eliminating the need to turn off pump 20 in order to obtain a substantially accurate approximation of the air chamber pressure. As a result, a desired pressure setpoint within air chamber 14A or 14B can be achieved without the need for turning pump 20 off to allow the pressures to equalize. The latter method of approximating an air chamber pressure using mathematical relationships between the air chamber pressure and the pump manifold pressure is described in detail in U.S. application Ser. No. 12/936,084, the entirety of which is incorporated herein by reference.

Figure 3:
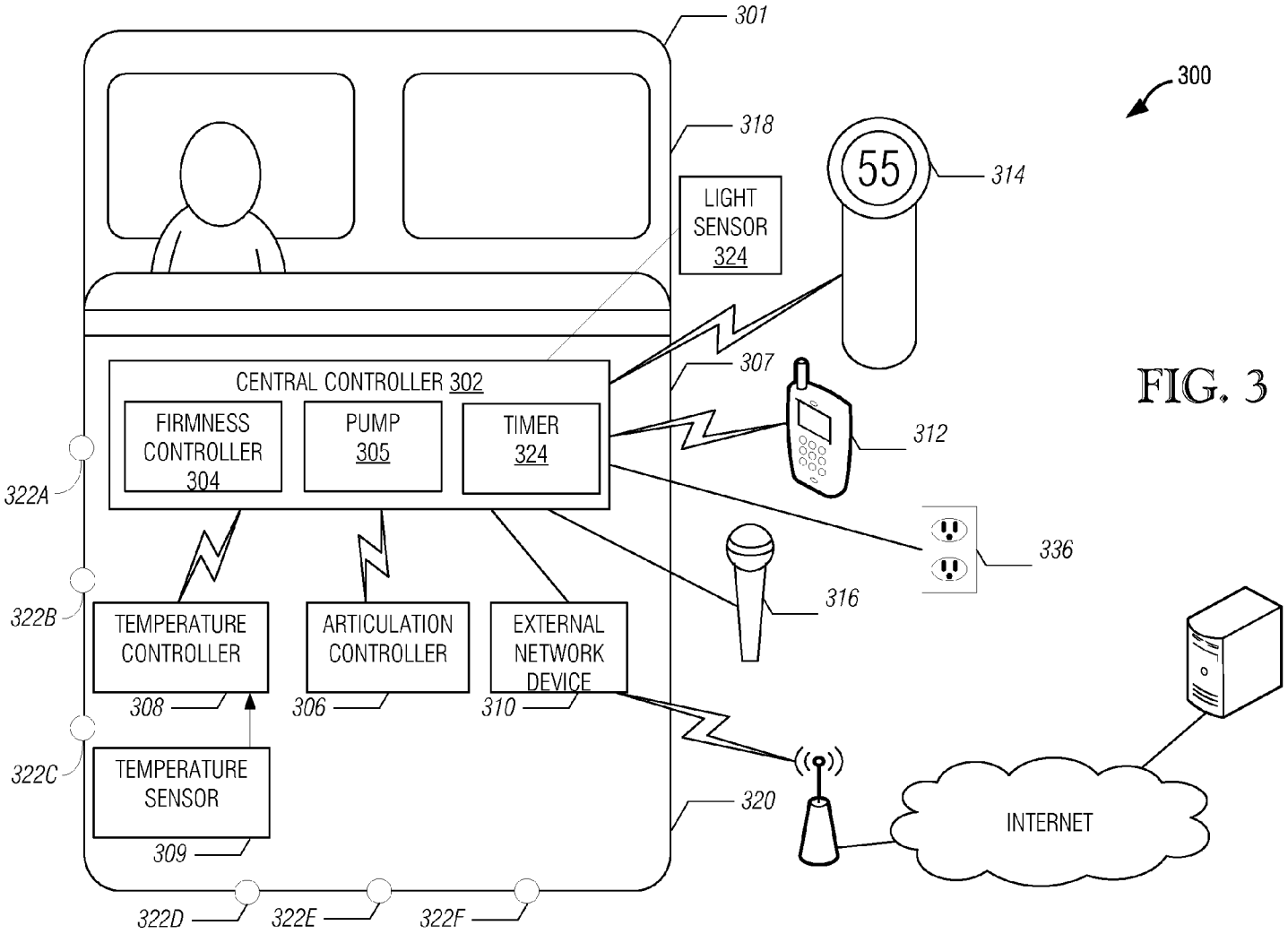
FIG. 3 is a block diagram of an air bed system architecture, according to an example.

FIG. 3 illustrates an example air bed system architecture 300. Architecture 300 includes bed 301, e.g., an inflatable air mattress, central controller 302, firmness controller 304, articulation controller 306, temperature controller 308 in communication with one or more temperature sensors 309, external network device 310, remote controllers 312, 314, and voice controller 316. While described as using an air bed, the system architecture may also be used with other types of beds.

As illustrated in FIG. 3, the central controller 302 includes firmness controller 304 and pump 305. The network bed architecture 300 is configured as a star topology with central controller 302 and firmness controller 304 functioning as the hub and articulation controller 306, temperature controller 308, external network device 310, remote controls 312, 314, and voice controller 316 functioning as possible spokes, also referred to herein as components. Thus, in various examples, central controller 302 acts a relay between the various components.

In yet another example, central controller 302 listens to communications (e.g., control signals) between components even if the communication is not being relayed through central controller 302. For example, consider a user sending a command using remote 312 to temperature controller 308. Central controller 302 may listen for the command and check to determine if instructions are stored at central controller 302 to override the command (e.g., it conflicts with a previous setting). Central controller 302 may also log the command for future use (e.g., determining a pattern of user preferences for the components).

In other examples, different topologies may be used. For example, the components and central controller 302 may be configured as a mesh network in which each component may communicate with one or all of the other components directly, bypassing central controller 302. In various examples, a combination of topologies may be used. For example, remote controller 312 may communicate directly to temperature controller 308 but also relay the communication to central controller 302.

In various examples, the controllers and devices illustrated in FIG. 3 may each include a processor, a storage device, and a network interface. The processor may be a general purpose central processing unit (CPU) or application-specific integrated circuit (ASIC). The storage device may include volatile or non-volatile static storage (e.g., Flash memory, RAM, EPROM, etc.). The storage device may store instructions which, when executed by the processor, configure the processor to perform the functionality described herein. For example, a processor of firmness control 304 may be configured to send a command to a relief valve to decrease the pressure in a bed.

In various examples, the network interface of the components may be configured to transmit and receive communications in a variety of wired and wireless protocols. For example, the network interface may be configured to use the 802.11 standards (e.g., 802.11a/b/c/g/n/ac), PAN network standards such as 802.15.4 or Bluetooth, infrared, cellular standards (e.g., 3G/4G etc.), Ethernet, and USB for receiving and transmitting data. The previous list is not intended to exhaustive and other protocols may be used. Not all components of FIG. 3 need to be configured to use the same protocols. For example, remote control 312 may communicate with central controller 302 via Bluetooth while temperature controller 308 and articulation controller 306 are connected to central controller using 802.15.4. Within FIG. 3, the lightning connectors represent wireless connections and the solid lines represent wired connections, however, the connections between the components is not limited to such connections and each connection may be wired or wireless. For example, the voice controller 316 can be connected wirelessly to the central controller 302.

Moreover, in various examples, the processor, storage device, and network interface of a component may be located in different locations than various elements used to effect a command. For example, as in FIG. 1, firmness controller 302 may have a pump that is housed in a separate enclosure than the processor used to control the pump. Similar separation of elements may be employed for the other controllers and devices in FIG. 3.

In various examples, firmness controller 304 is configured to regulate pressure in an air mattress. For example, firmness controller 304 may include a pump such as described with reference to FIG. 2 (see e.g., pump 20). Thus, in an example, firmness controller 304 may respond to commands to increase or decrease pressure in the air mattress. The commands may be received from another component or based on stored application instructions that are part of firmness controller 304.

As illustrated in FIG. 3 central controller 302 includes firmness controller 304. Thus, in an example, the processor of central controller 302 and firmness control 304 may be the same processor. Furthermore, the pump may also be part of central controller 302. Accordingly, central controller 302 may be responsible for pressure regulation as well as other functionality as described in further portions of this disclosure.

In various examples, articulation controller 306 is configured to adjust the position of a bed (e.g., bed 301) by adjusting a foundation 307 that supports the bed. In an example, separate positions may be set for two different beds (e.g., two twin beds placed next to each other). The foundation 307 may include more than one zone, e.g., head portion 318 and foot portion 320, that may be independently adjusted. Articulation controller 306 may also be configured to provide different levels of massage to a person on the bed.

In various examples, temperature controller 308 is configured to increase, decrease, or maintain the temperature of a user. For example, a pad may be placed on top of or be part of the air mattress. Air may be pushed through the pad and vented to cool off a user of the bed. Conversely, the pad may include a heating element that may be used to keep the user warm. In various examples, the pad includes the temperature sensor 309 and temperature controller 308 receives temperature readings from the temperature sensor 309. In other examples, the temperature sensor 309 can be separate from the pad, e.g., part of the air mattress or foundation.

In various examples, additional controllers may communicate with central controller 302. These controllers may include, but are not limited to, illumination controllers for turning on and off light elements placed on and around the bed and outlet controllers for controlling power to one or more power outlets.

In various examples, external network device 310, remote controllers 312, 314 and voice controller 316 may be used to input commands (e.g., from a user or remote system) to control one or more components of architecture 300. The commands may be transmitted from one of the controllers 312, 314, or 316 and received in central controller 302. Central controller 302 may process the command to determine the appropriate component to route the received command. For example, each command sent via one of controllers 312, 314, or 316 may include a header or other metadata that indicates which component the command is for. Central controller 302 may then transmit the command via central controller 302's network interface to the appropriate component.

For example, a user may input a desired temperature for the user's bed into remote control 312. The desired temperature may be encapsulated in a command data structure that includes the temperature as well as identifies temperature controller 308 as the desired component to be controlled. The command data structure may then be transmitted via Bluetooth to central controller 302. In various examples, the command data structure is encrypted before being transmitted. Central controller 302 may parse the command data structure and relay the command to temperature controller 308 using a PAN. Temperature controller 308 may then configure its elements to increase or decrease the temperature of the pad depending on the temperature originally input into remote control 312.

In various examples, data may be transmitted from a component back to one or more of the remote controls. For example, the current temperature as determined by a sensor element of temperature controller 308, e.g., temperature sensor 309, the pressure of the bed, the current position of the foundation or other information may be transmitted to central controller 302. Central controller 302 may then transmit the received information and transmit it to remote control 312 where it may be displayed to the user.

In various examples, multiple types of devices may be used to input commands to control the components of architecture 300. For example, remote control 312 may be a mobile device such as a smart phone or tablet computer running an application. Other examples of remote control 312 may include a dedicated device for interacting with the components described herein. In various examples, remote controls 312/314 include a display device for displaying an interface to a user. Remote control 312/314 may also include one or more input devices. Input devices may include, but are not limited to, keypads, touchscreen, gesture, motion and voice controls.

Remote control 314 may be a single component remote configured to interact with one component of the mattress architecture. For example, remote control 314 may be configured to accept inputs to increase or decrease the air mattress pressure. Voice controller 316 may be configured to accept voice commands to control one or more components. In various examples, more than one of the remote controls 312/314 and voice controller 316 may be used.

With respect to remote control 312, the application may be configured to pair with one or more central controllers. For each central controller, data may be transmitted to the mobile device that includes a list of components linked with the central controller. For example, consider that remote control 312 is a mobile phone and that the application has been authenticated and paired with central controller 302. Remote control 312 may transmit a discovery request to central controller 302 to inquiry about other components and available services. In response, central controller 302 may transmit a list of services that includes available functions for adjusting the firmness of the bed, position of the bed, and temperature of the bed. In various embodiments, the application may then display functions for increasing/decreasing pressure of the air mattress, adjusting positions of the bed, and adjusting temperature. If components are added/removed to the architecture under control of central controller 302, an updated list may be transmitted to remote control 312 and the interface of the application may be adjusted accordingly.

In various examples, central controller 302 is configured as a distributor of software updates to components in architecture 300. For example, a firmware update for temperature controller 308 may become available. The update may be loaded into a storage device of central controller 302 (e.g., via a USB interface). Central controller 302 may then transmit the update to temperature controller 308 with instructions to update. Temperature controller 308 may attempt to install the update. A status message may be transmitted from temperature controller 308 to central controller 302 indicating the success or failure of the update.

In various examples, central controller 302 is configured to analyze data collected by a pressure transducer (e.g., transducer 46 with respect to FIG. 2) to determine various states of a person lying on the bed. For example, central controller 302 may determine the heart rate or respiration rate of a person lying in the bed. Additional processing may be done using the collected data to determine a possible sleep state of the person. For example, central controller 302 may determine when a person falls asleep and, while asleep, the various sleep states of the person.

In various examples, external network device 310 includes a network interface to interact with an external server for processing and storage of data related to components in architecture 300. For example, the determined sleep data as described above may be transmitted via a network (e.g., the Internet) from central controller 302 to external network device 310 for storage. In an example, the pressure transducer data may be transmitted to the external server for additional analysis. The external network device 310 may also analyze and filter the data before transmitting it to the external server.

In an example, diagnostic data of the components may also be routed to external network device 310 for storage and diagnosis on the external server. For example, if temperature controller 308 detects an abnormal temperature reading (e.g., a drop in temperature over one minute that exceeds a set threshold) diagnostic data (sensor readings, current settings, etc.) may be wireless transmitted from temperature controller 308 to central controller 302. Central controller 302 may then transmit this data via USB to external network device 310. External device 310 may wirelessly transmit the information to an WLAN access point where it is routed to the external server for analysis.

In one example, the bed system 300 can include one or more lights 322A-322F (referred to collectively in this disclosure as "lights 322") to illuminate a portion of a room, e.g., when a user gets out of the bed 301. The lights 322 can be attached around the foundation 307, e.g., affixed to the foundation around its perimeter. In FIG. 3, the lights 322 are depicted as extending around two sides of the foundation 307. In other configurations, the lights 322 can extend around more than two sides of the foundation 307, or only a single side. In one example implementation, the lights 322 can be positioned underneath the foundation 307 to project light outwardly from the foundation 307.

Example Machine Architecture and Machine-Readable Medium

Figure 4:
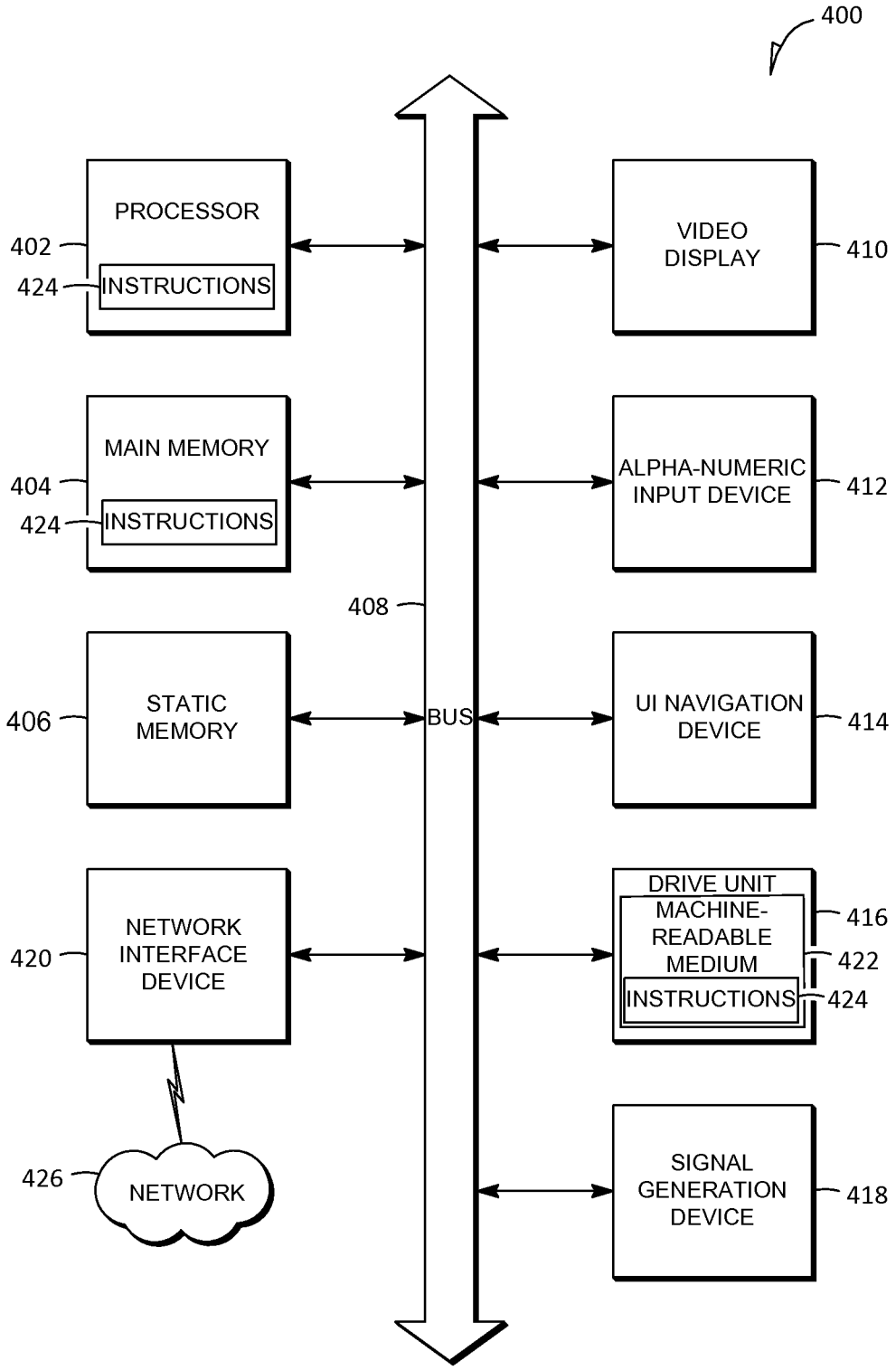
FIG. 4 is a block diagram of machine in the example form of a computer system within which a set instructions, for causing the machine to perform any one or more of the methodologies discussed herein, may be executed.
Figure 7:
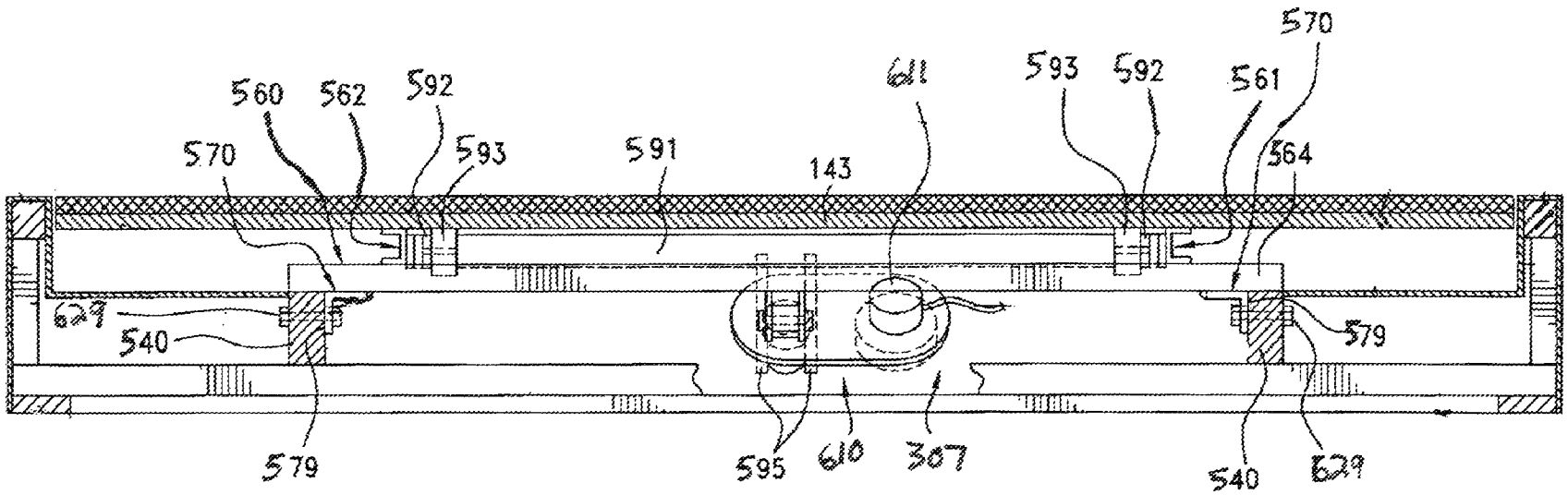
FIG. 7 is a cross-sectional view taken generally along line 7-7 of FIG. 5, and illustrates the manner in which one of a pair of transverse rails is secured by brackets and bolts to a pair of substantially parallel support members of the bed foundation.
Figure 8:
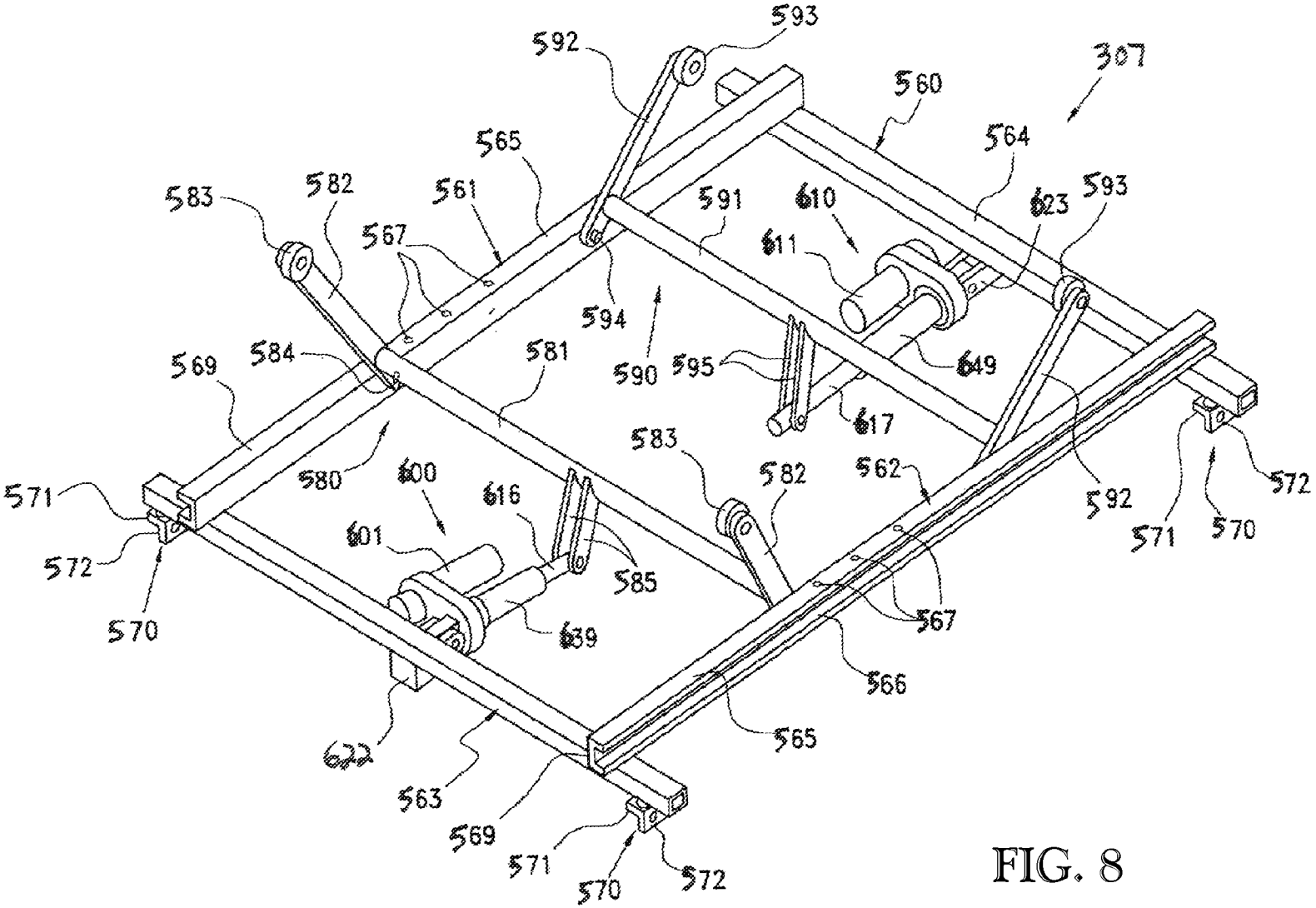
FIG. 8 is a perspective view of the adjustable bed mechanism, and illustrates the various linkages and drive mechanisms thereof.
Figure 9:
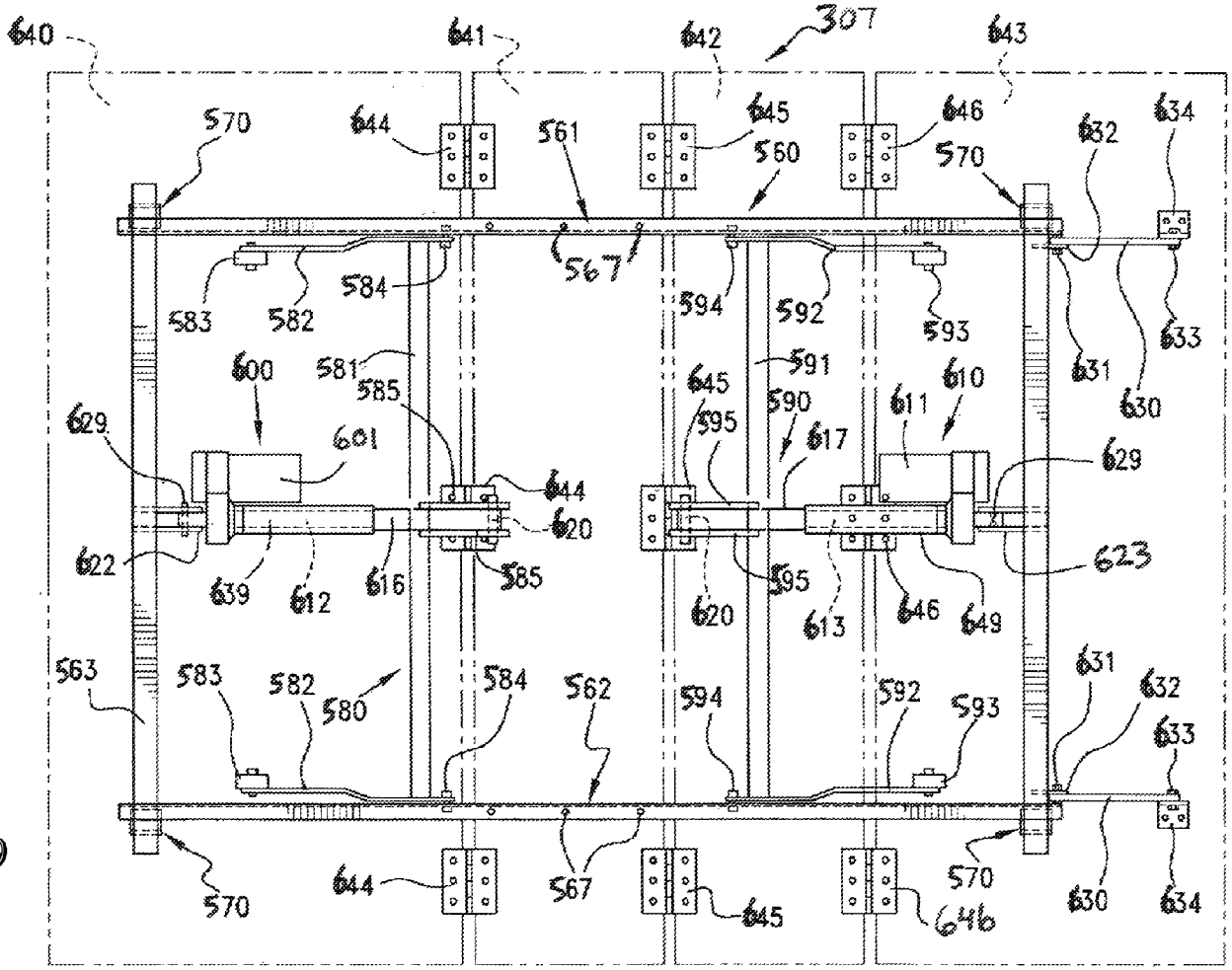
FIG. 9 is a top perspective view of the support frame of the adjustable bed mechanism, and illustrates opposite parallel side rails joined to opposite parallel foot and head rails, the two linkage mechanisms and the two drive mechanism therefor.
Figure 10:
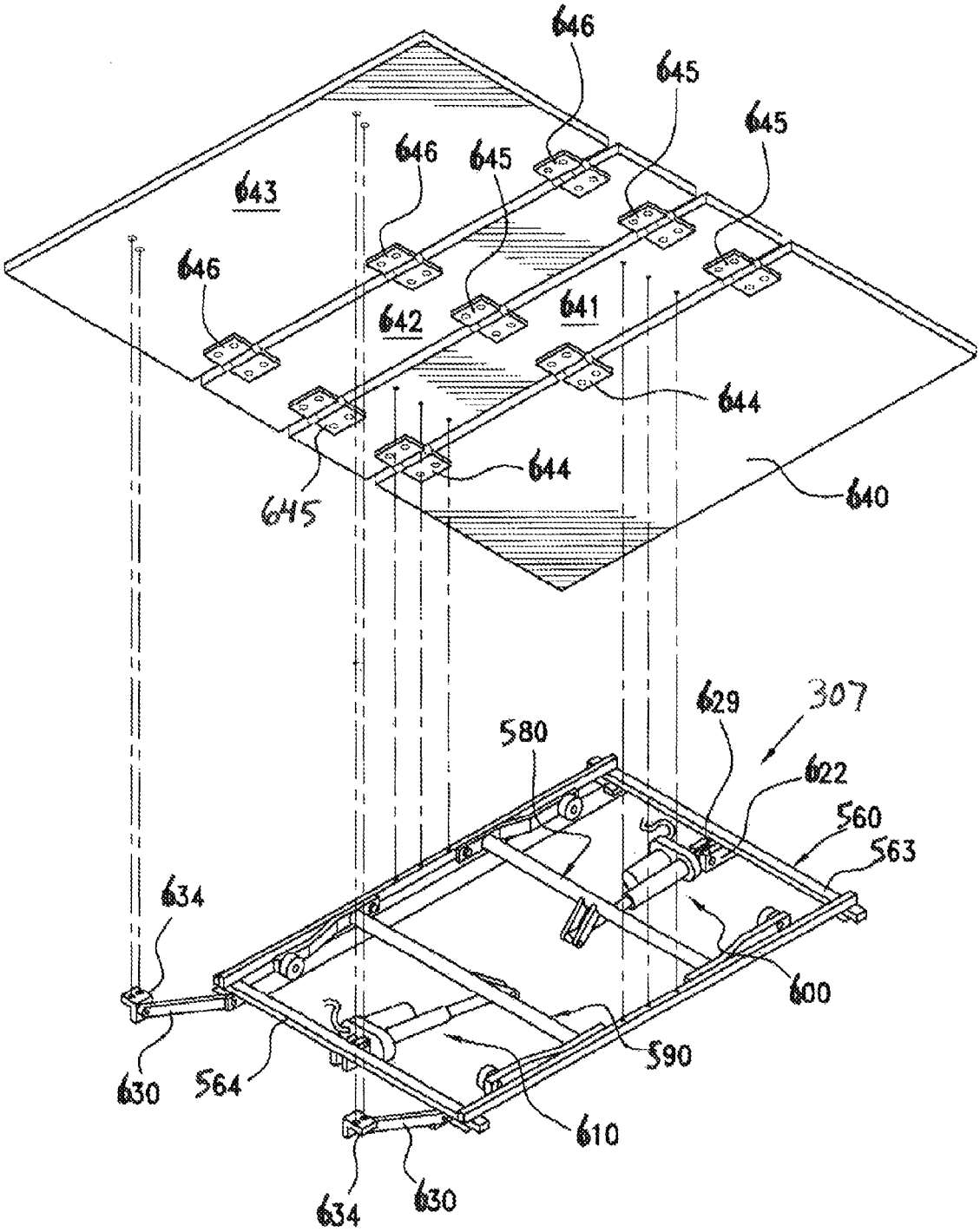
FIG. 10 is an exploded perspective view of the adjustable bed mechanism, and illustrates the manner in which a seat board and a footboard are assembled to side rails and foot links, respectively, of the bed-adjusting mechanism to unitize the same prior to "drop-in" assembly thereof relative to the bed foundation.

FIG. 4 is a block diagram of machine in the example form of a computer system 400 within which instructions, for causing the machine to perform any one or more of the methodologies discussed herein, may be executed. In alternative embodiments, the machine operates as a standalone device or may be connected (e.g., networked) to other machines. In a networked deployment, the machine may operate in the capacity of a server or a client machine in server-client network environment, or as a peer machine in a peer-to-peer (or distributed) network environment. The machine may be a personal computer (PC), a tablet PC, a set-top box (STB), a Personal Digital Assistant (PDA), a cellular telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

The example computer system 400 includes a processor 402 (e.g., a central processing unit (CPU), a graphics processing unit (GPU), ASIC or a combination), a main memory 404 and a static memory 406, which communicate with each other via a bus 408. The computer system 400 may further include a video display unit 410 (e.g., a liquid crystal display (LCD) or a cathode ray tube (CRT)). The computer system 400 also includes an alphanumeric input device 412 (e.g., a keyboard and/or touchscreen), a user interface (UI) navigation device 414 (e.g., a mouse), a disk drive unit 416, a signal generation device 418 (e.g., a speaker) and a network interface device 420.

Machine-Readable Medium

The disk drive unit 416 includes a machine-readable medium 422 on which is stored one or more sets of instructions and data structures (e.g., software) 424 embodying or utilized by any one or more of the methodologies or functions described herein. The instructions 424 may also reside, completely or at least partially, within the main memory 404 and/or within the processor 402 during execution thereof by the computer system 400, the main memory 404 and the processor 402 also constituting machine-readable media.

While the machine-readable medium 422 is shown in an example embodiment to be a single medium, the term "machine-readable medium" may include a single medium or multiple media (e.g., a centralized or distributed database, and/or associated caches and servers) that store the one or more instructions or data structures. The term "machine-readable medium" shall also be taken to include any tangible medium that is capable of storing, encoding or carrying instructions for execution by the machine and that cause the machine to perform any one or more of the methodologies of the present invention, or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including by way of example semiconductor memory devices, e.g., Erasable Programmable Read-Only Memory (EPROM), Electrically Erasable Programmable Read-Only Memory (EEPROM), and flash memory devices; magnetic disks such as internal hard disks and removable disks; magneto-optical disks; and CD-ROM and DVD-ROM disks.

Transmission Medium

The instructions 424 may further be transmitted or received over a communications network 426 using a transmission medium. The instructions 424 may be transmitted using the network interface device 420 and any one of a number of well-known transfer protocols (e.g., HTTP). Examples of communication networks include a local area network ("LAN"), a wide area network ("WAN"), the Internet, mobile telephone networks, Plain Old Telephone (POTS) networks, and wireless data networks (e.g., WiFi and WiMax networks). The term "transmission medium" shall be taken to include any intangible medium that is capable of storing, encoding or carrying instructions for execution by the machine, and includes digital or analog communications signals or other intangible media to facilitate communication of such software.

Adjustable Foundation Operation

FIGS. 5-10 illustrate various views of the adjustable foundation 307 in accordance with an example of the present disclosure. The adjustable foundation 307 can be similar to the various adjustable foundations described in U.S. Pat. No. 6,951,037, which is incorporated herein by reference in its entirety. In particular, the adjustable foundation 307 can be a unitized structure and can include a support 560 defined by opposite substantially parallel longitudinal side rails 561, 562 and spaced substantially parallel head and foot rails 563, 564, respectively. The side rails 561, 562 can generally be of C-shaped cross-sectional configurations which open away from each other (FIG. 8) and can each include an upper flange 565, a lower flange 566 and a web 569 therebetween. The upper flanges 565 can include a plurality of spaced openings 567 and the lower flanges 566 can be welded to upper surfaces of the head rail 563 and the foot rail 564, each of which can be of a generally polygonal cross-sectional tubular configuration (FIGS. 5 and 6). Located inboard from each end of the respective head and foot rails 563, 564, a metal angle bracket 617 (FIGS. 7 and 8) can be provided that is defined by an upper horizontal flange 571 and a depending vertical flange 572. The upper flanges 571 of the angle brackets 570 can be welded to the underside of the associated head rail 563 and foot rail 564. The vertical flanges 572 of the angle brackets 570 can be brought into engagement with one or more longitudinal support members 540, 540 (FIG. 7) of underlying frame or foundation sections.

In various examples, the support 560 (FIGS. 8-10) of the adjustable foundation 307 can carry as part of the unitized assembly a headboard adjusting linkage mechanism 580 for adjusting the head portion 318 (FIG. 3), a foot board adjusting linkage mechanism 590 for adjusting the foot portion 320 (FIG. 3), a headboard drive mechanism 600 and a footboard drive mechanism 610.

The headboard adjusting linkage mechanism 580 can include a lift tube 581 which can be welded at opposite ends thereof to lift arms 582, 582, each carrying at one end thereof a roller or follower 583 and being connected at opposite ends thereof to the web 569 of the side rails 561, 562 by pivot means 584 in the form of bolts and nuts, or any other suitable fastening means. A pair of spaced parallel arms 585, 585 can be welded at one end substantially centrally or medially of the lift tube 581 and can have aligned apertures at opposite ends thereof.

The footboard adjusting linkage mechanism 590 can include a lift tube 591 which can be welded at opposite ends thereof to lift arms 592, 592, each carrying at one end thereof a roller or follower 593 and being connected at opposite ends thereof to the web 569 of the side rails 561, 562 by pivot means 594 in the form of bolts and nuts, or any other suitable fastening means. A pair of spaced parallel arms 595, 595 can be welded at one end substantially centrally or medially of the lift tube 591 and can have aligned apertures at opposite ends thereof.

The headboard drive mechanism 600 and the footboard drive mechanism 610 can be identical or can have a different configuration. Each of the drive mechanisms 600, 610 can include a motor 601, 611, respectively, which can be selectively rotated in opposite directions through the central controller 302 discussed above which, in an example, can rotate a respective screw 612, 613 which in turn can extend or retract a respective lift rod 616, 617. The lift rods 616, 617 can be connected by respective pivot pins or pivot means 120 to the respective brackets 585, 595. A generally U-shaped bracket 622, 623 (FIGS. 5, 6, 8 and 9) can be welded to an underside of the respective head rail 563 and foot rail 564 and opposite ends of the brackets 622, 623 can be pivotally connected by pivots 629 to a housing 639, 649 of the respective drive mechanisms 600, 610.

A pair of foot links 630 can be connected by pivots 631 to brackets 632 which can be welded to the foot rail 564 at one end thereof. Opposite ends of the links 630 can have brackets 634 pivotally connected thereto by pivot means 633.

The adjustable foundation 307 can further include a headboard 640, a seat board 641, a thigh board 642 and a footboard 643. The headboard 640 and the seat board 641 can be connected to each other by pivot means 644. The seat board 641 and the thigh board 642 can be pivotally connected to each other by pivot means 645. The thigh board 642 and the footboard 643 can be pivotally connected to each other by pivot means 646.

Screws or similar fasteners can connect the brackets 634 to the footboard 643 and like screws passing through the openings 567 of the side rails 561, 562 can fasten the side rails 561, 562 to the seat board 641. Therefore, the entire adjustable foundation 307 can be a unitized structure defined by the support 560, the linkage mechanisms 580, 590 carried thereby, the drive means 600, 610 carried thereby, and the boards 640-643 also carried thereby. Thus, the entire unitized adjustable foundation 307 can be "drop-in" assembled with a foundation surround and/or underlying frame.

As discussed above, the bed 301 can include a single foundation 307 or multiple foundations 307 positioned side-by-side. In an example, the bed 301 can include a single foundation 307 configured to adjust the position of a bed having a single mattress. In another example, the bed 301 can include two side-by-side foundations 307 configured to operate in tandem to adjust the position of a bed having a single mattress. In yet another example, the bed 301 can include two side-by-side mattresses supported by two side-by-side foundations 307, wherein the foundations 307 are operable independently such that separate positions may be set for the two different mattresses of the bed 301. Each of the foundations 307 in the above examples can include the independently adjustable head portion 318 and foot portion 320.

Consider, for example, a bed 301 having two side-by-side adjustable foundations 307 supporting two side-by-side mattresses. In this configuration, each of the foundations 307 can include the headboard drive mechanism 600 and the footboard drive mechanism 610 described above, thereby allowing the user on each side to independently adjust the head portion 318 and/or the foot portion 320. However, when a bed 301 is instead provided having two side-by-side adjustable foundations 307 supporting a single mattress, a problem can arise when, for example, the user on one side adjusts the head portion 318 and/or the foot portion 320 to a position that is different than the corresponding positions on the other side of the bed. Thus, in this alternative configuration having a single mattress and two side-by-side adjustable foundations 307, there is a need for syncing the operation of the headboard drive mechanism 600 and the footboard drive mechanism 610 in each of the foundations 307 such that the two foundations 307 operate similar to a single foundation. The present disclosure contemplates a system and method for selecting between various bed configurations to achieve the desired bed adjustability.

Physical Configuration Switch

Figure 11:
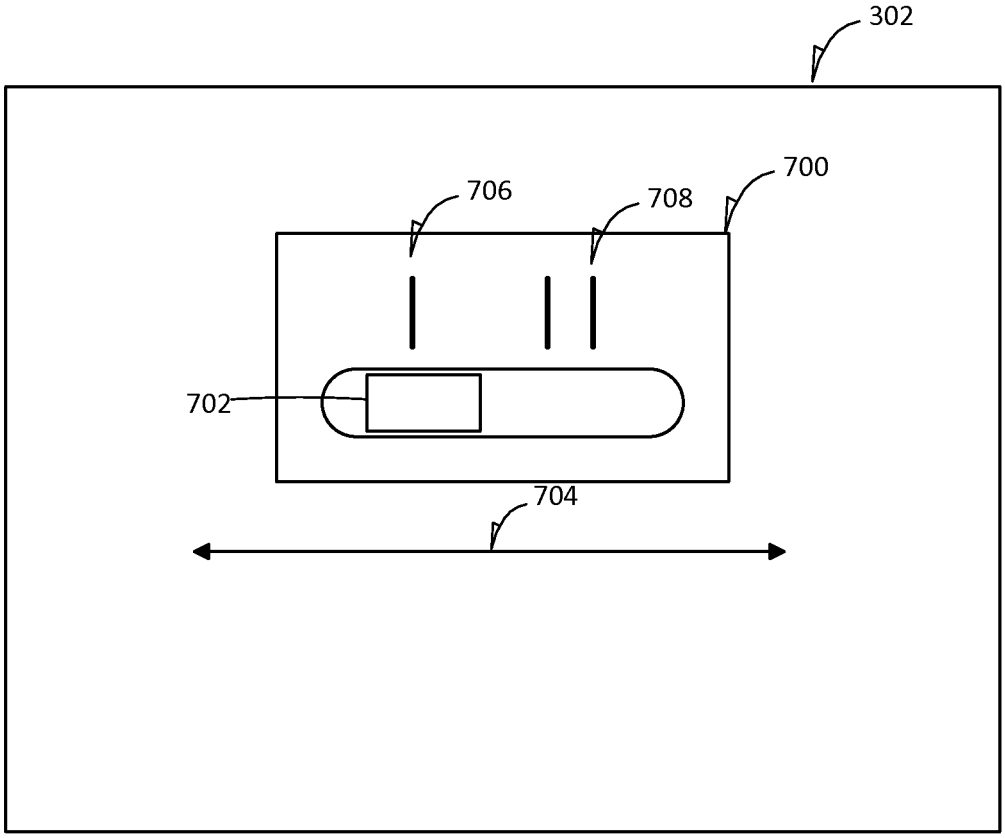
FIG. 11 is a diagram illustrating an example of a configurable device that may be used to implement various techniques of this disclosure.

FIG. 11 is a diagram illustrating an example of a configurable device that can be used to implement various techniques of this disclosure. For example, FIG. 11 depicts a configuration switch 700 located on the central controller 302. The configuration switch 700 is shown as located on the central controller 302 merely for purposes of example and not limitation. Thus, the configuration switch 700 can be located on any other component of the bed 301 without departing from the intended scope of the present disclosure.

In various examples, the configuration switch 700 can include a switch member 702 that can be moved between multiple positions as indicated by arrow 704. As illustrated in FIG. 11, the configuration switch 700 can include a first position 706 and a second position 708. In an example, the first position 706 can be configured to allow the headboard drive mechanism 600 and the footboard drive mechanism 610 of a first adjustable foundation 307 to operate independent of the headboard drive mechanism 600 and the footboard drive mechanism 610 of a second adjustable foundation 307. Thus, the first position 706 can be selected when the particular bed configuration includes two side-by-side adjustable foundations 307 supporting two side-by-side mattresses. In this configuration, each of the users can have independent control for adjusting the head portion 318 and/or the foot portion 320 of their side of the bed 301.

In an example, the second position 708 can be configured to allow the headboard drive mechanism 600 and the footboard drive mechanism 610 of a first adjustable foundation 307 to be synced with the operation of the headboard drive mechanism 600 and the footboard drive mechanism 610 of a second adjustable foundation 307. Thus, the second position 708 can be selected when the particular bed configuration includes two side-by-side adjustable foundations 307 supporting a single mattress. In this configuration, when one of the users makes a selection on a remote control device to adjust the head portion 318 and/or the foot portion 320, the corresponding drive mechanisms of the first adjustable foundation 307 and the second adjustable foundation 307 can operate in tandem to adjust both sides of the bed to the selected position.

Figure 12:
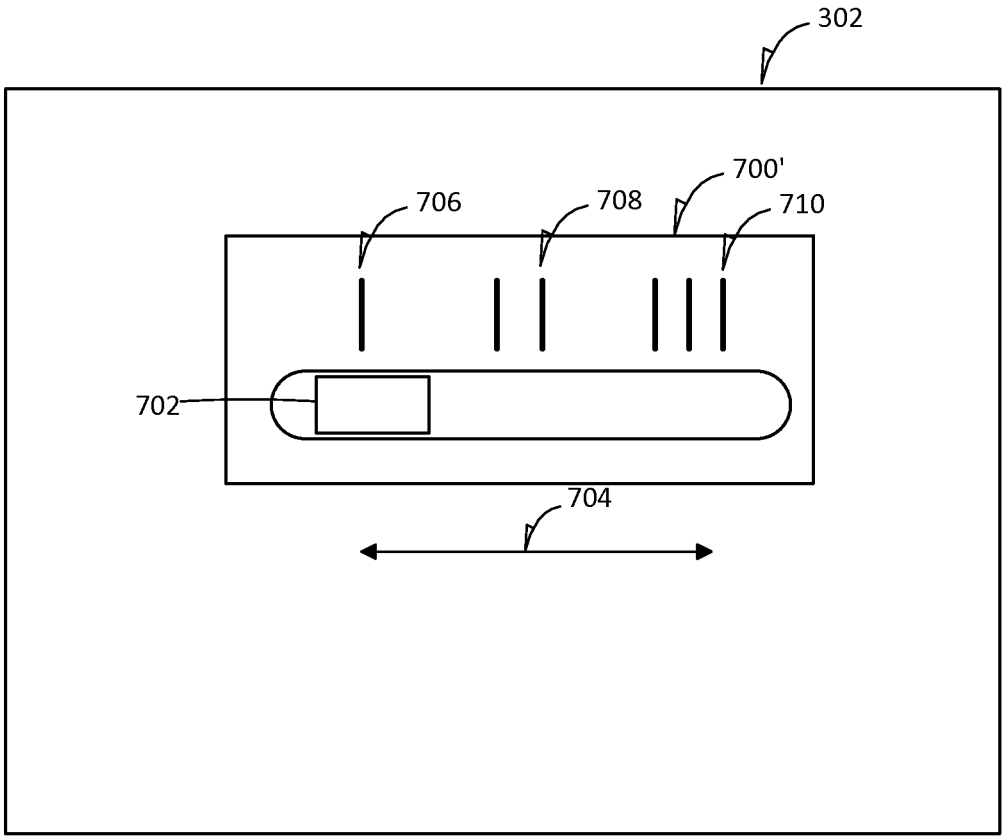
FIG. 12 is a diagram illustrating another example of a configurable device that may be used to implement various techniques of this disclosure.

FIG. 12 is a diagram illustrating another example of a configurable device that can be used to implement various techniques of this disclosure. For example, FIG. 12 depicts an alternative configuration switch 700' located on the central controller 302. In various examples, the configuration switch 700' can include the switch member 702 that can be moved between multiple positions as indicated by arrow 704. In addition to the first position 706 and the second position 708 discussed above with reference to the configuration switch 700, the configuration switch 700' can include a third position 710. In an example, the third position 710 can be available for use in a bed configuration having a single adjustable foundation 307 supporting a single mattress. In this configuration, independent or synced control of the headboard drive mechanism 600 and the footboard drive mechanism 610 of two side-by-side foundations is irrelevant because there is only a single foundation 307. Thus, when the switch member 702 is moved to the third position 710, the central controller 302 or the articulation controller 306 can disable control of the missing second foundation 307 and provide instructions solely to the first foundation 307.

In another example, the third position 710 can be configured to allow the footboard drive mechanism 610 of a first adjustable foundation 307 to be synced with the operation of the footboard drive mechanism 610 of a second adjustable foundation 307 and the headboard drive mechanism 600 of a first adjustable foundation 307 to operate independent of the headboard drive mechanism 600 of a second adjustable foundation 307. Thus, the third position 710 can be selected when the particular bed configuration includes two side-by-side adjustable foundations 307 supporting one split top mattress. In this configuration, each of the users can have independent control for adjusting the head portion 318 of their side of the bed 301.

Switching Techniques for Adjustable Foundations

Figure 13:
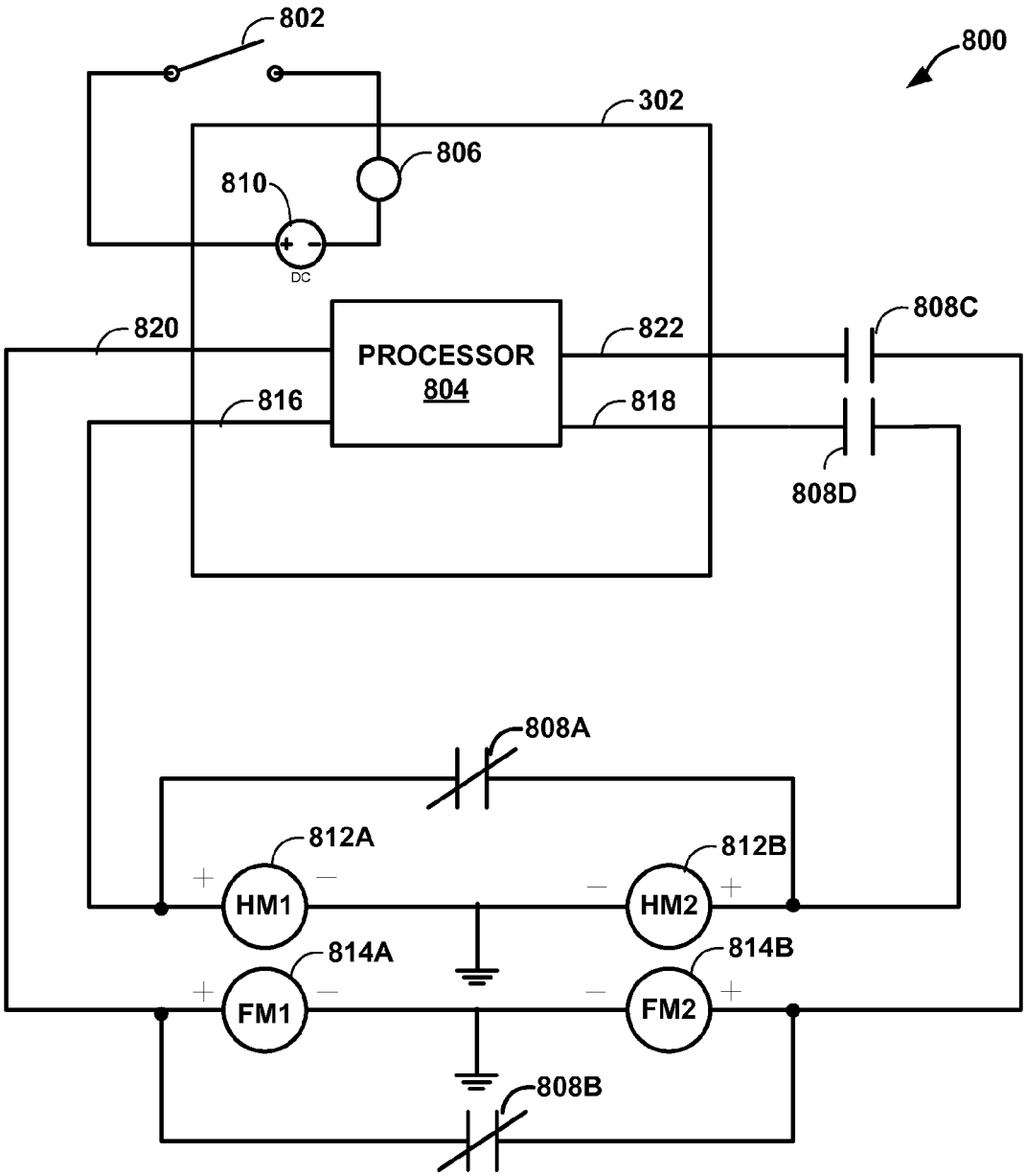
FIG. 13 is a block diagram illustrating an example circuit for providing coordinated control of multiple motors of an adjustable foundation system in accordance with this disclosure.

FIG. 13 is a block diagram illustrating an example circuit for providing coordinated control of multiple motors of an adjustable foundation system in accordance with this disclosure. More particularly, FIG. 13 depicts an example circuit 800 having a configurable device 802, e.g., switches 700, 700', and a central controller 302 that includes a processor 804, a relay coil 806 and a plurality of relay contacts 808A-808D (referred to collectively in this disclosure as "contacts 808"), and a power source 810, e.g., direct current (DC) power source, for providing power to the relay coil 806. The configurable device 802 has a first state and second state, e.g., a first switch position 706 and a second switch position 708 of FIG. 11, and is configurable based on user input. For example, a user may switch configurable device 802 from the first state (or position) 706 of FIG. 11 to the second state (or position) 708 of FIG. 11.

FIG. 13 further depicts a first headboard motor 812A and a first footboard motor 814A for adjusting the head portion 318 and the foot portion 320, respectively, of a first adjustable foundation, e.g., the left side of the foundation, and a second headboard motor 812B and a second footboard motor 814B, for adjusting the head portion 318 and the foot portion 320, respectively, of a second adjustable foundation, e.g., the right side of the foundation. The headboard motors 812A, 812B may be similar to the motors 601 of FIG. 6, and the footboard motors 814A, 814B may be similar to the motors 611 of FIG. 6. For simplicity, only control signal lines to the motors 812A-814B, and not power supply lines, have been depicted.

In accordance with this disclosure, the central controller 302 may be configured to control a plurality of motors, e.g., the motors 812A-814B, based on input received from a user via the configurable device 802. For example, in some example configurations, it may be desirable for the first headboard motor 812A (also shown as "HM1" in FIG. 13) of the first adjustable foundation and a second headboard motor 812B (also shown as "HM2" in FIG. 13) of a second adjustable foundation to operate in coordination with one another. That is, the first headboard motor 812A and the second headboard motor 812B may operate at substantially the same time, e.g., synchronously, and in substantially the same manner, e.g., when one motor is raising the first headboard the other motor is raising the second headboard to substantially the same inclination.

Similarly, it may be desirable for the first footboard motor 814A (also shown as "FM1" in FIG. 13) of the first adjustable foundation and a second footboard motor 814B (also shown as "FM2" in FIG. 13) of a second adjustable foundation to operate in coordination with one another. That is, the first footboard motor 814A and the second footboard motor 814B may operate at substantially the same time, e.g., synchronously, and in substantially the same manner, e.g., when one motor is lowering the first footboard the other motor is lowering the second footboard to substantially the same inclination.

Coordination between the motors may be desirable with certain bed configurations. For example, a king size bed systems may include a single air mattress placed over two adjustable foundations, e.g., a right adjustable foundation and a left adjustable foundation. Because of the placement of the single mattress over both foundations, it may be desirable to coordinate operation of the motors so that the two sides of the bed operate uniformly.

During an initial set-up of the system 300, for example, a user may configure the device 802, e.g., a switch. The device 802 may be, for example, a two-way switch, a three-way switch (or other multi-way switch), a single-pole double-throw switch, or any other type of switch or device that has two or more states or positions. The device 802 in FIG. 13 is depicted in a first state as set by a user, e.g., a switch in an open position. The relay contacts 808A, 808B are normally-closed (NC) contacts and the relay contacts 808C, 808D are normally-open (NO) contacts. Because the device 802 is in an open position, the relay coil 806 of the central controller 302 is not energized and the relay contacts 808A-808D remain in their normal positions, as shown in FIG. 13.

Upon receiving a command to operate the first headboard motor 812A, the processor 804 outputs a control signal via signal line 816 that operates both the first head portion motor 812A and the second headboard motor 812B via NC contact 808A. Any control signals from the processor 804 via signal line 818 to operate the second headboard motor 812B are blocked by NO contact 808D, thereby preventing the two head motors 812A, 812B from operating independently of one another.

Similarly, upon receiving a command to operate the first footboard motor 814A, the processor 804 outputs a control signal via signal line 820 that operates both the first foot portion motor 814A and the second footboard motor 814B via NC contact 808B. Any control signals from the processor 804 via signal line 822 to operate the second footboard motor 814B are blocked by NO contact 808C, thereby preventing the two footboard motors 814A, 814B from operating independently of one another.

In this manner, the processor is configured to control the headboard motors 812A, 812B and/or the footboard motors 814A, 814B based on the input received from the user. It should be noted that the configuration depicted in FIG. 13 is just one example configuration that illustrates coordinated operation of the motors 812A-814B. Other example configurations are considered within the scope of this disclosure.

Figure 14:
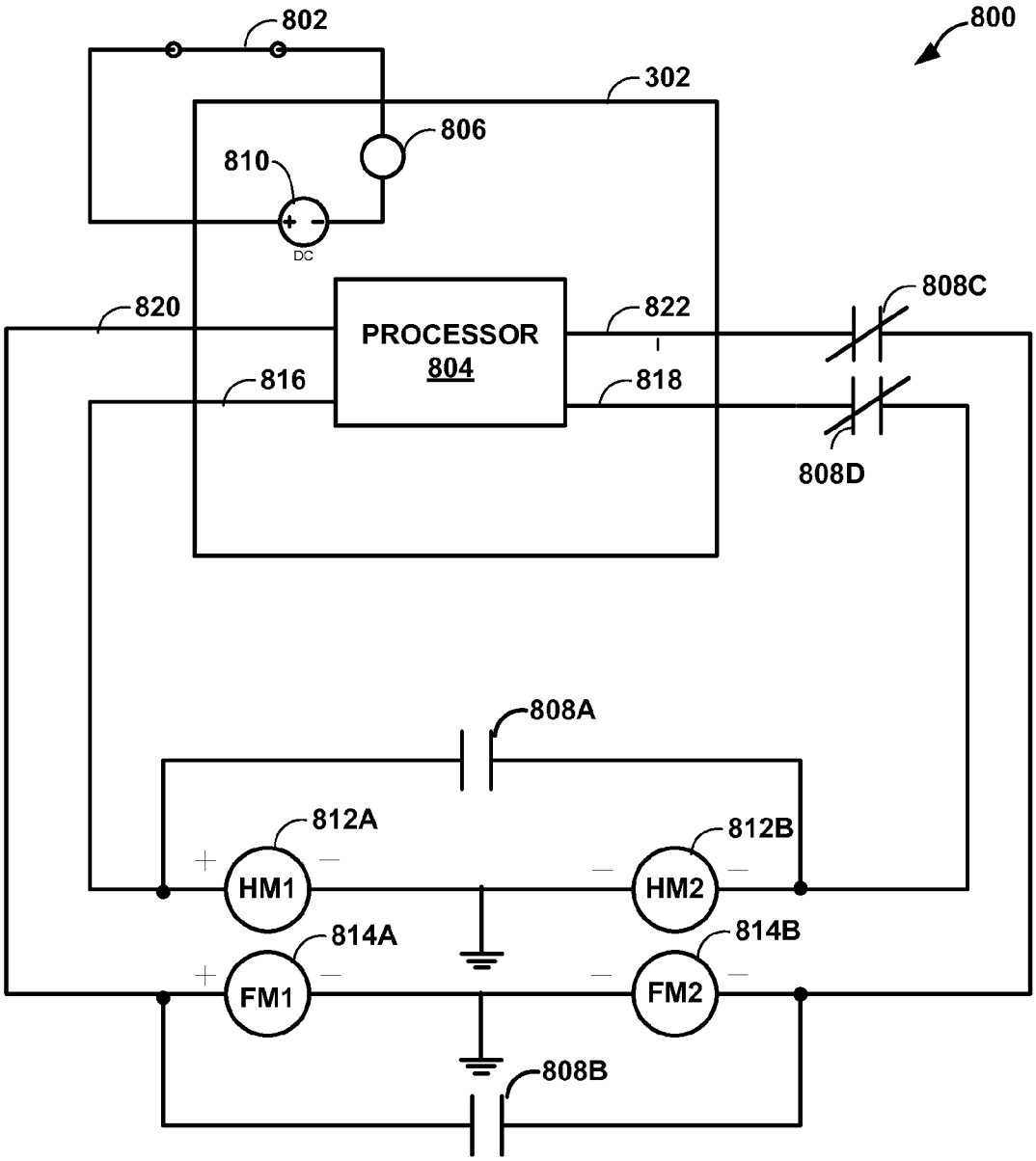
FIG. 14 is a block diagram illustrating an example circuit for providing independent control of multiple motors of an adjustable foundation system in accordance with this disclosure.

FIG. 14 is a block diagram illustrating an example circuit for providing independent control of multiple motors of an adjustable foundation system in accordance with this disclosure. FIG. 14 depicts the example circuit 800 of FIG. 13 with the configurable device 802 depicted in a second state as set by a user, e.g., a switch in a closed position. For purposes of conciseness, the components of the circuit 800 will not be described again in detail.

In contrast to the coordinated control of motors described above with respect to FIG. 13, in some example configurations, it may be desirable for the first headboard motor 812A of the first adjustable foundation and the second headboard motor 812B of the second adjustable foundation to operate independently of one another. For example, when the first headboard motor 812A is raising the first headboard, the second headboard motor 812B may lower the second headboard, or not move the second headboard at all.

Similarly, it may be desirable for the first footboard motor 814A of the first adjustable foundation and the second footboard motor 814B of the second adjustable foundation to operate independently of one another. For example, when the first footboard motor 814A is raising the first footboard, the second footboard motor 814B may lower the second footboard, or not move the second footboard at all.

Independence between the motors 812A-814B may be desirable with certain bed configurations. For example, a split king size bed systems may include first and second air mattresses placed, respectively, over first and second adjustable foundations, e.g., a right adjustable foundation and a left adjustable foundation. Because of the split mattress configuration, it may be desirable to allow independent operation of the motors 812A-814B.

During an initial set-up of the system 300, for example, a user may configure the device 802, e.g., a switch. Again, the device 802 may be, for example, a two-way switch, a three-way switch (or other multi-way switch), a single-pole double-throw switch, or any other type of switch or device that has two or more states or positions. The device 802 in FIG. 14 is depicted in a second state as set by a user, e.g., a switch in a closed position. Because the device 802 is in a closed position, the relay coil 806 of the central controller 302 is energized. The relay contacts 808A-808D change from their normal positions, as shown in FIG. 13, to the positions depicted in FIG. 14. That is, the relay contacts 808A, 808B open and the relay contacts 808C, 808D close.

Upon receiving a command to operate the first headboard motor 812A, the processor 804 outputs a control signal via signal line 816. In response, the first head portion motor 812A operates, but the second headboard motor 812B will not operate due to the open relay contact 808A. Any control signals from the processor 804 via signal line 818 to operate the second headboard motor 812B are permitted through closed relay contact 808D, thereby allowing the two head motors 812A, 812B to operate independently of one another.

Similarly, upon receiving a command to operate the first footboard motor 814A, the processor 804 outputs a control signal via signal line 820. In response, the first foot portion motor 814A operates, but the second footboard motor 814B will not operate due to the open relay contact 808B. Any control signals from the processor 804 via signal line 822 to operate the second footboard motor 814B are permitted through closed relay contact 808C, thereby allowing the two foot motors 814A, 814B to operate independently of one another.

In this manner, the processor 804 is configured to control the head motors 812A, 812B and/or the foot motors 814A, 814B based on the input received from the user. It should be noted that the configuration depicted in FIG. 14 is just one example configuration that illustrates independent operation of the motors 812A-814B. Other example configurations are considered within the scope of this disclosure.

In some example implementations, the configurable device 802 may be a mechanical device, e.g., a mechanical switch, as described above with respect to FIGS. 13 and 14. In other examples, the configurable device may be an electronic switch. In yet another example, the configurable device may be a memory device that stores a user input, as described in more detail below with respect to FIGS. 15 and 16.

Figure 15:
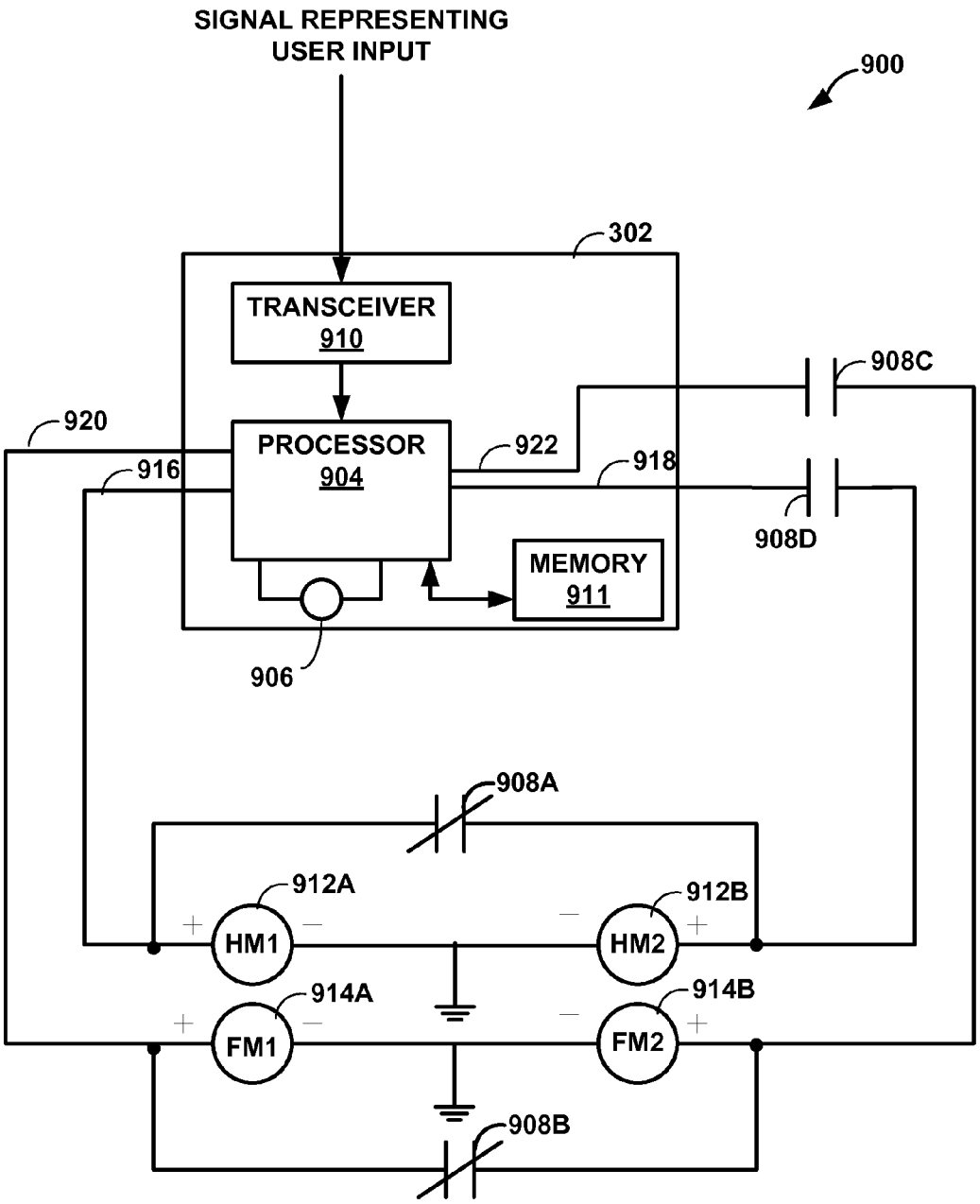
FIG. 15 is a block diagram illustrating another example circuit for providing coordinated control of multiple motors of an adjustable foundation system in accordance with this disclosure.

FIG. 15 is a block diagram illustrating another example circuit for providing coordinated control of multiple motors of an adjustable foundation system in accordance with this disclosure. More particularly, FIG. 15 depicts an example circuit 900 having a central controller 302 that includes a processor 904, a relay coil 906 and a plurality of relay contacts 908A-908D (referred to collectively in this disclosure as "contacts 908"), a transceiver 910, and a configurable device 911, e.g., a memory device. The configurable device 911 has a first state and second state, e.g., a cell of a memory device that stores either a high logic level or a low logic level, and is configurable based on user input.

In one example, a user may use a remote controller, e.g., remote controller 314 of FIG. 3, to configure the memory device 911. The user input may be a selection that represents whether the user has, for example, a king size bed or a split king size bed. As indicated above, split king size bed may have two mattresses and two adjustable foundations and, as a result, the motors on the two sides of the bed may be operated independently of one another. In contrast, a king size bed may have a single mattress and two adjustable foundations and, as a result, the motors on the two sides of the bed may be operated in coordination with one another.

In one example, during initial configuration of the bed system 300, the user may use a remote controller to transmit a signal representing a user input selection to the transceiver 910. The transceiver 910 may forward the signal to the processor 904, which stores in the memory 911 a logic level representing the received user input. For example, a low logic level may represent that the user transmitted a selection of a king size bed and a high logic level may represent that the user transmitted a selection of a split king size bed.

FIG. 15 further depicts a first head portion motor 912A and a first footboard motor 914A for adjusting the head portion 318 and the foot portion 320, respectively, of a first adjustable foundation, e.g., the left side of the foundation, and a second head portion motor 912B and a second footboard motor 914B for adjusting the head portion 318 and the foot portion 320, respectively, of a second adjustable foundation, e.g., the right side of the foundation. For simplicity, only control signal lines to the motors 912A-914B, and not power supply lines, have been depicted.

Upon receiving a command to operate the first headboard motor 912A, for example, the processor 904 retrieves from the memory device 911 the previously stored logic level that represents the user selection. Based upon the retrieved logic level, the processor 904 controls the energizing of the relay coil 906. The relay contacts 908A, 908B are normally-closed (NC) contacts and the relay contacts 908C, 908D are normally-open (NO) contacts.

In one example, if the retrieved logic level from the memory device 911 represents a user selection of a king size bed, the processor 904 does not output a control signal to energize the relay coil 906. Upon receiving a command to operate the first headboard motor 912A, the processor 904 outputs a control signal via signal line 916 that operates both the first headboard motor 912A and the second headboard motor 912B via NC contact 908A. Any control signals from the processor 904 via signal line 918 to operate the second headboard motor 912B are blocked by NO contact 908D, thereby preventing the two head motors 912A, 912B from operating independently of one another.

Similarly, upon receiving a command to operate the first footboard motor 914A, the processor 904 outputs a control signal via signal line 920 that operates both the first footboard motor 914A and the second footboard motor 914B via NC contact 908B. Any control signals from the processor 904 via signal line 922 to operate the second footboard motor 914B are blocked by NO contact 908C, thereby preventing the two foot motors 914A, 914B from operating independently of one another.

In this manner, the processor is configured to control the head motors 912A, 912B and/or the foot motors 914A, 914B based on the input received from the user and stored in the device 911. It should be noted that the configuration depicted in FIG. 15 is just one example configuration that illustrates coordinated operation of the motors 912A-914B. Other example configurations are considered within the scope of this disclosure.

Figure 16:
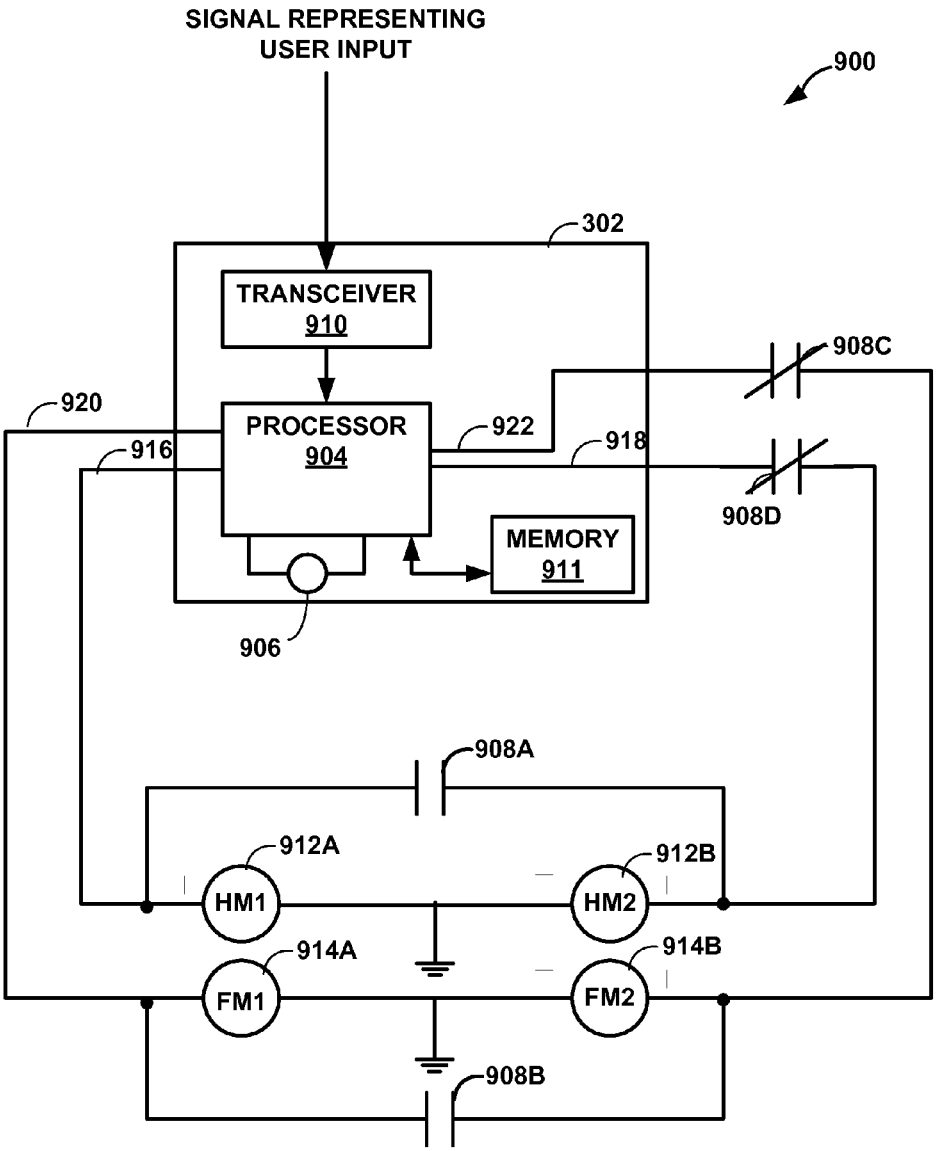
FIG. 16 is a block diagram illustrating an example circuit for providing independent control of multiple motors of an adjustable foundation system in accordance with this disclosure.

FIG. 16 is a block diagram illustrating an example circuit for providing independent control of multiple motors of an adjustable foundation system in accordance with this disclosure. FIG. 16 depicts the example circuit 900 of FIG. 15 with after the relay coil 906 has been energized. For purposes of conciseness, the components of the circuit 900 will not be described again in detail.

In contrast to the coordinated control of motors described above with respect to FIG. 15, in some example configurations, it may be desirable for the first headboard motor 912A of the first adjustable foundation and the second headboard motor 912B of the second adjustable foundation to operate independently of one another. That is, the first headboard motor 912A and the second headboard motor 912B operate independent of one another, e.g., when one motor is raising the first headboard, the other motor can lower the second headboard, or not moving the second headboard at all.

Similarly, it may be desirable for the first footboard motor 914A of the first adjustable foundation and a second footboard motor 914B of the second adjustable foundation to operate independently of one another. That is, the first footboard motor 914A and the second footboard motor 914B may operate independent of one another, e.g., when one motor is raising the first footboard, the other motor can lower the second footboard, or not moving the second footboard at all.

In one example, during initial configuration of the bed system 300, the user may use a remote controller to transmit a signal representing a user input selection to the transceiver 910. The transceiver 910 may forward the signal to the processor 904, which stores in the memory device 911 a logic level representing the received user input. For example, a low logic level may represent that the user transmitted a selection of a king size bed and a high logic level may represent that the user transmitted a selection of a split king size bed.

Upon receiving a command to operate the first headboard motor 912A, for example, the processor 904 retrieves from the memory device 911 the previously stored logic level that represents the user selection. Based upon the retrieved logic level, the processor 904 controls the energizing of the relay coil 906.

In one example, if the retrieved logic level from the memory device 911 represents a user selection of a split king size bed, the processor 904 may output a control signal to energize the relay coil 906, which will open the relay contacts 908A, 908B and close the relay contacts 908C, 908D. Upon receiving a command to operate the first headboard motor 912A, the processor 904 may output a control signal via signal line 916. In response, the first headboard motor 912A operates, but the second headboard motor 912B will not operate due to the open relay contact 908A. Any control signals from the processor 904 via signal line 918 to operate the second headboard motor 912B are permitted through closed relay contact 908D, thereby allowing the two headboard motors 912A, 912B to operate independently of one another.

Similarly, upon receiving a command to operate the first footboard motor 914B, the processor 904 outputs a control signal via signal line 920. In response, the first footboard motor 914A operates, but the second footboard motor 914B will not operate due to the open relay contact 908B. Any control signals from the processor 904 via signal line 922 to operate the second footboard motor 914B are permitted through closed relay contact 908C, thereby allowing the two footboard motors 914A, 914B to operate independently of one another.

In this manner, the processor is configured to control the headboard motors 912A, 912B and/or the footboard motors 914A, 914B based on the input received from the user. It should be noted that the configuration depicted in FIG. 16 is just one example configuration that illustrates independent operation of the motors 912A-914B. Other example configurations are considered within the scope of this disclosure.

Although FIGS. 13-16 were described above with respect to two bed configurations and thus two states or positions for the configurable device, the disclosure is not so limited. In some example implementations, there may three or more bed configurations. As such, it may be desirable to use a multi-way switch having three or more states or positions. For example, it may be desirable with some bed configurations to disable any motor control signals to the second adjustable foundation. To that end, a three-way switch may be desirable.

FIGS. 13-16 were described using relay coils and contacts. In one example implementation, the relays may be electromechanical relays. In other example configurations, programmable logic controllers may be used.

In various examples, the positions of the head portion 318 and the foot portion 320 of the adjustable foundation 307 can be tracked using one or more encoder devices. The one or more encoder devices can be electromechanical devices that are configured to convert angular position or motion of a rotatable member to an analog or digital code. In an example, encoder devices can be operably coupled to the screw 612 of the headboard drive mechanism 600 and to the screw 613 of the footboard drive mechanism 610 in each of the adjustable foundations 307 of a side-by-side bed configuration.

The encoder devices can be configured to transmit signals to the central controller 302, or to another controller of the system architecture 300, to track the positions of the head portions 318 and the foot portions 320 of the side-by-side adjustable foundations 307. Thus, when the operation of the headboard drive mechanisms 600 and the footboard drive mechanisms 610 of two side-by-side foundations are synced, the encoder devices can monitor whether the two head portions 318 and/or foot portions 320 are moving at the same speed and to the same position.

In an example, the central controller 302 can obtain motor encoder readings from each of the encoder devices. The central controller 302 can be configured to obtain and process these encoder readings at any desired sampling rate, such as 5 times per second. If the central controller 302 determines that one or more of the headboard drive mechanisms 600 or footboard drive mechanisms 610 are operating at a different speed, the controller 302 can generate instructions to speed up or slow down one or more of the motors associated with the drive mechanisms to ensure that the movement is once again synced.

Any suitable encoder device can be utilized, such as an absolute encoder or an incremental encoder. In an example, absolute encoder devices can indicate the current position of the headboard drive mechanism screw 612 and the current position of the footboard drive mechanism screw 613. In another example, incremental encoder devices can provide information about the motion of the headboard drive mechanism screw 612 and the footboard drive mechanism screw 613, which can be further processed by the controller 302 into information such as speed, distance, and position.

Although an embodiment has been described with reference to specific example embodiments, it will be evident that various modifications and changes may be made to these embodiments without departing from the broader spirit and scope of the invention. Accordingly, the specification and drawings are to be regarded in an illustrative rather than a restrictive sense. The accompanying drawings that form a part hereof, show by way of illustration, and not of limitation, specific embodiments in which the subject matter may be practiced. The embodiments illustrated are described in sufficient detail to enable those skilled in the art to practice the teachings disclosed herein. Other embodiments may be utilized and derived therefrom, such that structural and logical substitutions and changes may be made without departing from the scope of this disclosure. This Detailed Description, therefore, is not to be taken in a limiting sense, and the scope of various embodiments is defined only by the appended claims, along with the full range of equivalents to which such claims are entitled. As it common, the terms "a" and "an" may refer to one or more unless otherwise indicated.

The invention claimed is:

1. An adjustable bed system comprising:

first and second adjustable foundations;

at least one first motor to adjust the first adjustable foundation;

at least one second motor to adjust the second adjustable foundation; and a central controller comprising a processor and configured to:

operate in an initial configuration time and in a separate operation time after the initial configuration time;

receive, in the initial configuration time, an input indicating a type of available types of a mattress or mattresses on the bed, wherein at least one available type is a single mattress on both the first and the second adjustable foundations; and operate, in the separate operation time after the initial configuration time, the first motor and the second motor based on the received input;

wherein the first motor is a first headboard motor and the second motor is a second headboard motor, wherein to operate, in the separate operation time after the initial configuration time, the first motor and the second motor based on the received input, the controller is configured to:

control the first headboard motor to operate in coordination with the second headboard motor; and control a first footboard motor to operate in coordination with a second footboard motor.

2. The system of claim 1, wherein to operate, in the separate operation time after the initial configuration time, the first motor and the second motor based on the received input, the controller is configured to:

control the at least one first motor to operate in coordination with the at least one second motor.

3. The system of claim 1, wherein to operate, in the separate operation time after the initial configuration time, the first motor and the second motor based on the received input, the controller is configured to:

control the at least one first motor to operate independently of the at least one second motor.

4. The system of claim 1, wherein the controller is further configured to store data related to the received input in a memory device for use in operating the first motor and the second motor based on the received input.

5. An adjustable bed system comprising:

first and second adjustable foundations;

at least one first motor to adjust the first adjustable foundation;

at least one second motor to adjust the second adjustable foundation; and a central controller comprising a processor and configured to:

operate in an initial configuration time and in a separate operation time after the initial configuration time;

receive, in the initial configuration time, an input indicating a type of available types of a mattress or mattresses on the bed, wherein at least one available type is a single mattress on both the first and the second adjustable foundations; and operate, in the separate operation time after the initial configuration time, the first motor and the second motor based on the received input;

wherein the first motor is a first headboard motor and the second motor is a second headboard motor, wherein to operate, in the separate operation time after the initial configuration time, the first motor and the second motor based on the received input, the controller is configured to:

control the first headboard motor to operate in coordination with the second headboard motor; and control a first footboard motor to operate in coordination with a second footboard motor; and wherein to operate, in the separate operation time after the initial configuration time, the first motor and the second motor based on the received input, the controller is configured to:

control the first headboard motor to operate independently of the second headboard motor; and control the first footboard motor to operate independently of the second footboard motor.

6. A method of controlling an adjustable bed system comprising:

first and second adjustable foundations;

at least one first motor to adjust the first adjustable foundation;

at least one second motor to adjust the second adjustable foundation; and a central controller comprising a processor and configured to:

operate in an initial configuration time and in a separate operation time after the initial configuration time;

receive, in the initial configuration time, an input indicating a type of available types of a mattress or mattresses on the bed, wherein at least one available type is a single mattress on both the first and the second adjustable foundations; and operate, in the separate operation time after the initial configuration time, the first motor and the second motor based on the received input;

the method comprising:

operating in an initial configuration time and in a separate operation time after the initial configuration time;

receiving, in the initial configuration time, an input indicating a type of available types of a mattress or mattresses on the bed, wherein at least one of the available types is a single mattress on both the first and the second adjustable foundations; and operating, in the separate operation time after the initial configuration time, the first motor and the second motor based on the received input;

wherein operating, in the separate operation time after the initial configuration time, the first motor and the second motor based on the received input comprises:

controlling a first headboard motor to operate in coordination with a second headboard motor; and controlling a first footboard motor to operate in coordination with a second footboard motor.

7. The method of claim 6, wherein operating, in the separate operation time after the initial configuration time, the first motor and the second motor based on the received input comprises:

controlling the at least one first motor to operate in coordination with the at least one second motor.

8. The method of claim 6, wherein operating, in the separate operation time after the initial configuration time, the first motor and the second motor based on the received input comprises:

controlling the at least one first motor to operate independently of the at least one second motor.

9. The method of claim 6, wherein operating, in the separate operation time after the initial configuration time, the first motor and the second motor based on the received input comprises:

controlling a first headboard motor to operate independently of a second headboard motor; and controlling a first footboard motor to operate independently of a second footboard motor.

10. An adjustable bed system comprising:

first and second adjustable foundations, the first adjustable foundation including a first headboard and a first footboard, the second adjustable foundation including a second headboard and a second footboard;

at least one first motor to adjust the first adjustable foundation, the at least one first motor including a first headboard motor to adjust the first headboard and a first footboard motor to adjust the first footboard;

at least one second motor to adjust the second adjustable foundation, the at least one second motor including a second headboard motor to adjust the second headboard and a second footboard motor to adjust the second footboard; and a central controller comprising a processor and configured to:

operate in an initial configuration time and in a separate operation time after the initial configuration time;

receive, in the initial configuration time, an input indicating a type of available types of a mattress or mattresses on the bed, wherein at least one of the available types is a single mattress on both the first and the second adjustable foundations; and operate, in the separate operation time after the initial configuration time, the first motor and the second motor based on the received input;

wherein to operate, in the separate operation time after the initial configuration time, the first motor and the second motor based on the received input, the controller is configured to:

control the first headboard motor to operate in coordination with the second headboard motor; and control the first footboard motor to operate in coordination with the second footboard motor.

11. The system of claim 10, wherein to operate, in the separate operation time after the initial configuration time, the first motor and the second motor based on the received input, the controller is configured to:

control the first headboard motor to operate independently of the second headboard motor; and control the first footboard motor to operate independently of the second footboard motor.

12. The system of claim 10, wherein the available types include a king size bed and a split king size bed.

13. The system of claim 12, wherein the available types include a split top mattress, wherein the controller is configured to operate first and second head board motors independently and to operate the first and second footboard motors in sync in response to receiving the input indicating the split top mattress.

* * * * *